US012202650B2

(12) United States Patent
Omori et al.

(10) Patent No.: US 12,202,650 B2
(45) Date of Patent: Jan. 21, 2025

(54) SYNTHETIC RESIN CAP

(71) Applicants: KABUSHIKI KAISHA YAKULT HONSHA, Tokyo (JP); TOHOSHOJI KABUSHIKI KAISHA, Osaka (JP); NIPPON CLOSURES CO., LTD., Tokyo (JP)

(72) Inventors: Shinji Omori, Hiratsuka (JP); Masaharu Ezaki, Hiratsuka (JP); Reiko Kohara, Hiratsuka (JP)

(73) Assignees: KABUSHIKI KAISHA YAKULT HONSHA, Tokyo (JP); TOHOSHOJI KABUSHIKI KAISHA; NIPPON CLOSURES CO., LTD, Tokyo (JP)

( * ) Notice: Subject to any disclaimer, the term of this patent is extended or adjusted under 35 U.S.C. 154(b) by 0 days.

(21) Appl. No.: 18/262,038

(22) PCT Filed: Jan. 24, 2022

(86) PCT No.: PCT/JP2022/002403
§ 371 (c)(1),
(2) Date: Jul. 19, 2023

(87) PCT Pub. No.: WO2022/163570
PCT Pub. Date: Aug. 4, 2022

(65) Prior Publication Data

US 2024/0092539 A1 Mar. 21, 2024

(30) Foreign Application Priority Data

Jan. 27, 2021 (JP) ..... 2021-010759
May 29, 2021 (JP) ..... 2021-090719

(51) Int. Cl.
*B65D 41/34* (2006.01)
*B65D 41/48* (2006.01)
*B65D 55/16* (2006.01)

(52) U.S. Cl.
CPC ..... *B65D 41/3428* (2013.01); *B65D 41/485* (2013.01); *B65D 55/16* (2013.01); *B65D 2401/30* (2020.05)

(58) Field of Classification Search
CPC ..... B65D 41/3409; B65D 41/3428; B65D 41/3447; B65D 41/485; B65D 41/325;
(Continued)

(56) References Cited

U.S. PATENT DOCUMENTS 2,990,077 A * 6/1961 Van Baarn ..... B65D 43/169 215/256
3,272,368 A * 9/1966 Van Baarn ..... B65D 41/485 215/320

(Continued)

FOREIGN PATENT DOCUMENTS

JP 56-20369 Y2 5/1981
JP 06-81955 U 11/1994

*Primary Examiner* — Chun Hoi Cheung
*Assistant Examiner* — Brijesh V. Patel
(74) *Attorney, Agent, or Firm* — FISHERBROYLES, LLP; Roger L. Browdy; Ronni S. Jillions

(57) ABSTRACT

[Object]
To provide a synthetic resin cap of a structure that is further improved in convenience when drinking while suppressing falling or loss of the cap when a container is opened.
[Solving Means]
A synthetic resin cap as a specific example of the present invention has a tamper-evident band to be fitted on an outer peripheral surface of a container mouth portion of a container, and a cap main body having a skirt wall and a top plate, and including, in the skirt wall, a fixing rib coupled with the tamper-evident band via a weakened portion and a strap portion and extending to a radially outer side of the skirt wall. The fixing rib is formed from a first inclined portion that flares downwards, and a protrusion portion that is disposed below the first inclined portion. When the
(Continued)

ENLARGEMENT OF FIXING RIB container is opened, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened.

11 Claims, 18 Drawing Sheets

(58) Field of Classification Search
CPC .... B65D 43/169; B65D 55/024; B65D 55/16; B65D 2401/20; B65D 2401/30; B65D 2401/35; B65D 2401/50; B65D 2251/10; B65D 2251/1008
USPC ..... 215/235, 243, 252–254, 258, 272, 306; 220/263, 268, 288, 375, 832, 836–837, 220/847
See application file for complete search history.

(56) References Cited

U.S. PATENT DOCUMENTS 4,158,902 A * 6/1979 Chernack ..... B65D 47/0819 220/838
5,007,555 A * 4/1991 Beck ..... B65D 47/0809 220/838
5,065,911 A * 11/1991 Rohr ..... B65D 47/0861 215/238
5,078,296 A * 1/1992 Amidzich ..... B65D 55/16 220/838
5,088,612 A * 2/1992 Storar ..... B65D 51/002 215/237
5,271,536 A * 12/1993 Wilson ..... A45C 13/005 222/498
5,335,802 A * 8/1994 Brach ..... B29C 45/26 215/253
5,464,112 A * 11/1995 Guillot ..... B65D 47/0833 220/257.1
5,605,240 A * 2/1997 Guglielmini ..... B65D 51/16 215/256
6,253,937 B1 * 7/2001 Anderson ..... B65D 47/0838 215/256
6,415,965 B2 * 7/2002 Nyman ..... B65D 35/44 222/517
6,460,712 B2 * 10/2002 Smith ..... B65D 47/0842 220/837
6,474,491 B1 * 11/2002 Benoit-Gonin .... B65D 41/3428 220/263
6,481,588 B1 * 11/2002 Wagner ..... B65D 41/485 220/831
6,609,624 B2 * 8/2003 Goto ..... A47G 19/2266 220/709
7,051,888 B2 * 5/2006 Antier ..... B65D 47/0804 220/831
7,073,679 B1 * 7/2006 Lagler ..... B65D 55/16 220/837
7,299,937 B2 * 11/2007 Antier ..... B65D 41/485 215/253
7,617,954 B2 * 11/2009 Skillin ..... B65D 47/0819 215/245
8,469,213 B2 * 6/2013 Ishii ..... B65D 41/3428 220/837
8,783,485 B2 * 7/2014 Logel ..... B65D 43/169 220/849
9,428,311 B2 * 8/2016 Bois ..... B65D 43/169
9,701,451 B2 * 7/2017 Skillin ..... B65D 47/0838
10,654,625 B2 * 5/2020 Migas ..... B65D 1/0246
10,800,581 B2 * 10/2020 Berroa Garcia ..... B65D 55/16
10,807,773 B2 * 10/2020 Bois ..... B65D 53/00
11,040,806 B2 * 6/2021 Naumann ..... B65D 41/485
11,485,550 B2 * 11/2022 Naumann ..... B65D 47/0823
11,535,436 B2 * 12/2022 Bassi ..... B65D 41/3428
11,603,237 B2 * 3/2023 Migas ..... B65D 47/0804
11,713,170 B2 * 8/2023 Mélan-Moutet ... B65D 41/3447 215/252
2002/0088813 A1 * 7/2002 Nyman ..... B65D 41/48 215/254
2003/0089746 A1 * 5/2003 Odet ..... B65D 47/148 215/254
2004/0178166 A1 * 9/2004 Antier ..... B65D 47/0804 215/235
2007/0151993 A1 * 7/2007 Yelland ..... B65D 23/102 222/546
2011/0068079 A1 * 3/2011 Luzatto ..... B65D 41/185 215/253
2018/0086510 A1 * 3/2018 Berroa Garcia ..... B65D 47/08
2021/0039841 A1 * 2/2021 Pucci ..... B65D 55/06
2022/0127048 A1 * 4/2022 Oomori ..... B65D 55/16
2022/0204228 A1 * 6/2022 Bassi ..... B26D 7/06
2023/0098984 A1 * 3/2023 Nakamura ..... B29D 99/0096 215/252
2023/0192365 A1 * 6/2023 Migas ..... B65D 41/325 215/253
2023/0264865 A1 * 8/2023 Krautkramer ..... B65D 55/16 220/835

* cited by examiner

ENLARGEMENT OF FIXING RIB

ENLARGEMENT OF FIXING RIB

SYNTHETIC RESIN CAP

TECHNICAL FIELD

The present invention relates to a synthetic resin cap, and in more detail to a synthetic resin cap of a structure that the synthetic resin cap is fitted, for example, to a container having a mouth portion and, even when the container is opened, its connection to the container mouth portion is maintained.

BACKGROUND ART

As containers for storing beverages, a variety of containers such as, for example, plastic bottles and beer bottles are known. Such containers are known in various forms according to the use, and as containers for storing, for example, milk beverages such as cow's milk, bottles on mouth portions of which (hereinafter also called "container mouth portions") caps are pushed and affixed are also known.

In general, when these containers are opened by taking off their caps from the mouth portions of the containers, the caps are typically separated from the container mouths, in many cases. As exemplified, for example, in PTL 1 or PTL 2, on the other hand, there is also known a cap with a cap main body coupled with a ring member or the like that will remain below the cap when the container is opened. PTL 1 and PTL 2 disclose a structure that the connection between a container mouth portion and a cap is maintained without separation of the cap from a container, even when the container is opened.

CITATION LIST

Patent Literature

[PTL 1]
JP H6-81955-U
[PTL 2]
JP S56-20369-Y

SUMMARY

Technical Problem

According to the cap structure exemplified in PTL 1 or PTL 2, the cap main body flips about the ring member, which remains on the lower part of the container mouth portion, as a base point, so that, when the container is opened, the cap is suppressed from falling or loss without separation from the container mouth portion. With conventional structures including those of PTL 1 and PTL 2, however, a problem such as that to be mentioned hereinafter still exists.

Described specifically, when drinking the contents stored in a container, a drinker also often drinks the contents directly via a container mouth portion in addition to pouring the contents to another container such as, for example, a glass.

With each conventional structure including that of PTL 1 or PTL 2, however, the cap main body, when the container is opened, is hard to sufficiently flip at the container mouth portion. Hence, there is undeniably a possibility that the drinker may feel a discomfort attributable to an interference such as, for example, a contact of the cap with the cheek, the nose, or the like of the drinker when drinking.

Further, if it is clear how much the cap main body is to be turned from the container mouth portion before the container is completely opened, it can be said that the convenience of the drinker is thereby improved.

With the conventional techniques including those of the above-described patent PTL 1 and PTL 2, there is still room for improvement as described above. Included as an example of an object which the present invention has is to provide a synthetic resin cap that makes it possible to prevent, when a drinker drinks contents from a container, the cap from coming into contact with the cheek, the nose, or the like of the drinker, also to easily grasp that the container has been completely opened as needed, while suppressing falling or loss of the cap when the container is opened.

Solution to Problem

To solve the above-described problem, a synthetic resin cap in one mode of the present invention has such a feature that (1) the synthetic resin cap includes a tamper-evident band to be fitted on an outer peripheral surface of a container mouth portion of a container, and a cap main body having a skirt wall and a top plate, and including, in the skirt wall, a fixing rib coupled with the tamper-evident band via a weakened portion and a strap portion and extending to a radially outer side of the skirt wall, in which the fixing rib is formed from a first inclined portion that flares downwards, and a protrusion portion that is disposed below the first inclined portion, and when the container is opened, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened.

As an alternative to solve the above-described problem, a synthetic resin cap in another one mode of the present invention has such a feature that (2) the synthetic resin cap includes a tamper-evident band to be fitted on an outer peripheral surface of a container mouth portion of a container, and a cap main body having a skirt wall and a top plate, and including, in the skirt wall, a fixing rib coupled with the tamper-evident band via a weakened portion and a strap portion and extending to a radially outer side of the skirt wall, in which the fixing rib has a protrusion portion including at least an intermediate step portion that extends to the radially outer side, a shoulder portion that is curved downwards at an outer end portion of the intermediate step portion, and a curved portion that is gradually reduced in diameter continuously downwards from the shoulder portion, when the container is opened, after a jaw portion disposed on the container mouth portion has slid along the curved portion, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened, and the protrusion portion further has a first inclined portion that is disposed above the intermediate step portion and flares downwards from the top plate.

Also, in the synthetic resin cap described above in (2), (3) the curved portion is preferably formed of a curved surface, the curved surface protruding upwardly in a state that the cap main body seals the container mouth portion such that an opening force required for turnover of the cap main body via the strap portion when the container is opened increases gradually.

Also, in the synthetic resin cap described above in any one of (1) to (3), (4) with the cap main body flipped beyond 180° about the strap portion as a base point from an unopened state, the posture of the cap main body when the container is opened is preferably maintained.

Also, in the synthetic resin cap described above in (4), (5) the protrusion portion is preferably set in height of arrangement from a lower end of the fixing rib such that the cap main body is flippable beyond 180°.

Also, in the synthetic resin cap described above in any one of (1) to (5), (6) when the container is opened, the first inclined portion slides on a side surface of the laterally extending portion, thereby preferably guiding an upper edge portion of the top plate to be driven onto an upper surface of the laterally extending portion.

Also, in the synthetic resin cap described above in (1), (7) the protrusion portion preferably includes an intermediate step portion that extends to a radially outer side of a lower end of the first inclined portion, a shoulder portion that is curved downwards at an outer end portion of the intermediate step portion, and an outer side surface portion that juts out to the radially outer side continuously from the shoulder portion, and the outer side surface portion is provided at a lower end thereof with a second inclined portion tapered downwards so as to suppress any interference with the tamper-evident band when the container is opened.

Also, in the synthetic resin cap described above in any one of (1) to (7), (8) the strap portion preferably has at least two connector straps, and the fixing rib is disposed so as to be interposed between the two connector straps.

Also, in the synthetic resin cap described above in any one of (1) to (8), (9) the cap main body preferably further includes a tab portion disposed on a side opposite to the fixing rib.

Also, in the synthetic resin cap described above in any one of (1) to (6), (10) the protrusion portion preferably includes at least an intermediate step portion that extends to the radially outer side, a shoulder portion that is curved downwards at an outer end portion of the intermediate step portion, and a curved portion that is gradually reduced in diameter continuously downwards from the shoulder portion, and the fixing rib comes into contact with the side surface of the container mouth portion to emit a sound after a jaw portion disposed on the container mouth portion has ridden over the curved portion.

As another alternative to solve the above-described problem, a synthetic resin cap in a further one mode of the present invention has such a feature that (11) the synthetic resin cap includes a tamper-evident band to be fitted on an outer peripheral surface of a container mouth portion of a container, and a cap main body having a skirt wall and a top plate, and including, in the skirt wall, a fixing rib coupled with the tamper-evident band via a weakened portion and a strap portion and extending to a radially outer side of the skirt wall, in which the fixing rib has a protrusion portion including at least an intermediate step portion that extends to the radially outer side, a shoulder portion that is curved downwards at an outer end portion of the intermediate step portion, and a curved portion that is gradually reduced in diameter continuously downwards from the shoulder portion, and when the container is opened, after a jaw portion disposed on the container mouth portion has slid along the curved portion, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened.

Advantageous Effects of Invention

According to the one aspect of the synthetic resin cap of the present invention, the cap main body is coupled with the tamper-evident band via the strap portion, thereby enabling to suppress falling or loss of the cap when the container is opened. In addition, when the container is opened, the side surface of the container mouth portion and the protrusion portion below the first inclined portion come into contact with each other, and the upper surface of the laterally extending portion below the container mouth portion and the top plate also come into contact with each other, whereby the posture of the cap main body when the container is opened is maintained, and convenience when drinking can further be improved.

According to the other aspects of the synthetic resin cap of the present invention, in addition to the advantageous effects described above, a drinker can be refrained from carelessly stopping opening before its completion, because when the container is opened, the jaw portion disposed on the container mouth portion slides along the curved portion and the resistance to riding of the jaw portion on the curved portion hence gradually increases.

BRIEF DESCRIPTION OF DRAWINGS

FIGS. 17A-10B (17A) is a rear view of the synthetic resin cap according to the second embodiment as seen from a side of a fixing rib, and (17B) is a rear view depicting another example of a connection manner of a strap portion to a skirt wall.

DESCRIPTION OF EMBODIMENTS

A description will hereinafter be given regarding embodiments for suitably practicing the present invention.

It is to be noted that, in these embodiments, X, Y, and Z directions are set as needed for the sake of convenience of description in descriptions in each of which one or more figures are used, but are for the convenience of description and do not excessively limit the present invention. Further, for other than the configurations to be mentioned in detail hereinafter, structures of known containers and caps can appropriately be applied.

First Embodiment

«Synthetic Resin Cap 100»

With reference to FIGS. 1 to 8 as needed, a description will be given in detail regarding a structure of a synthetic resin cap 100 according to a first embodiment.

Figure 1:
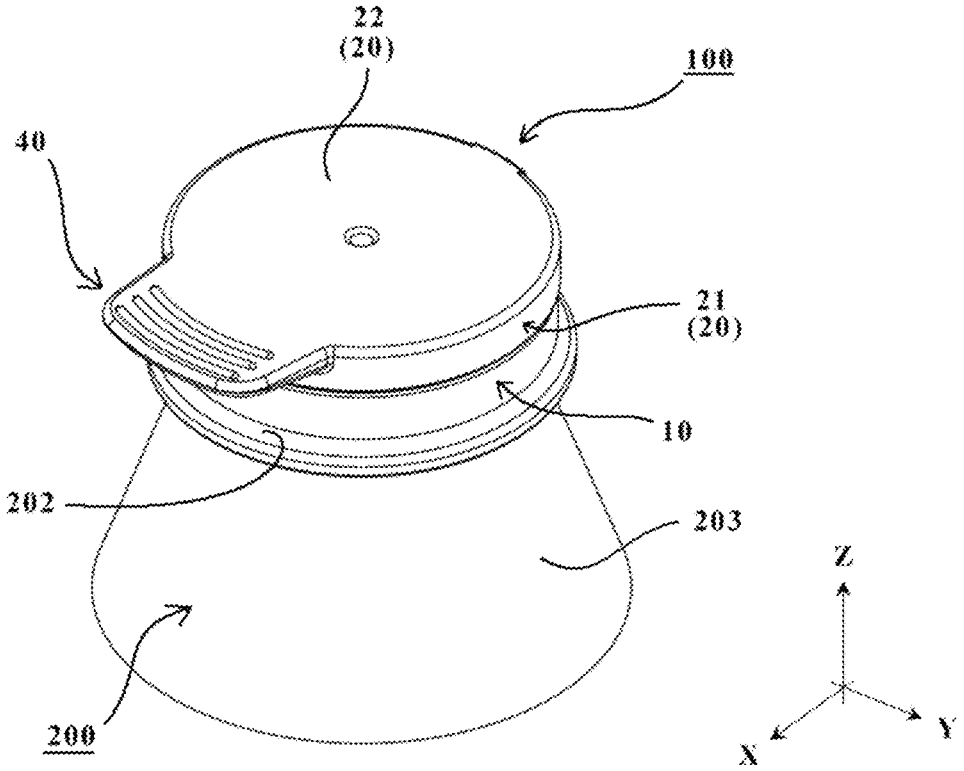
FIG. 1 is an external perspective view of a synthetic resin cap according to a first embodiment as seen from a direction.
Figure 2:
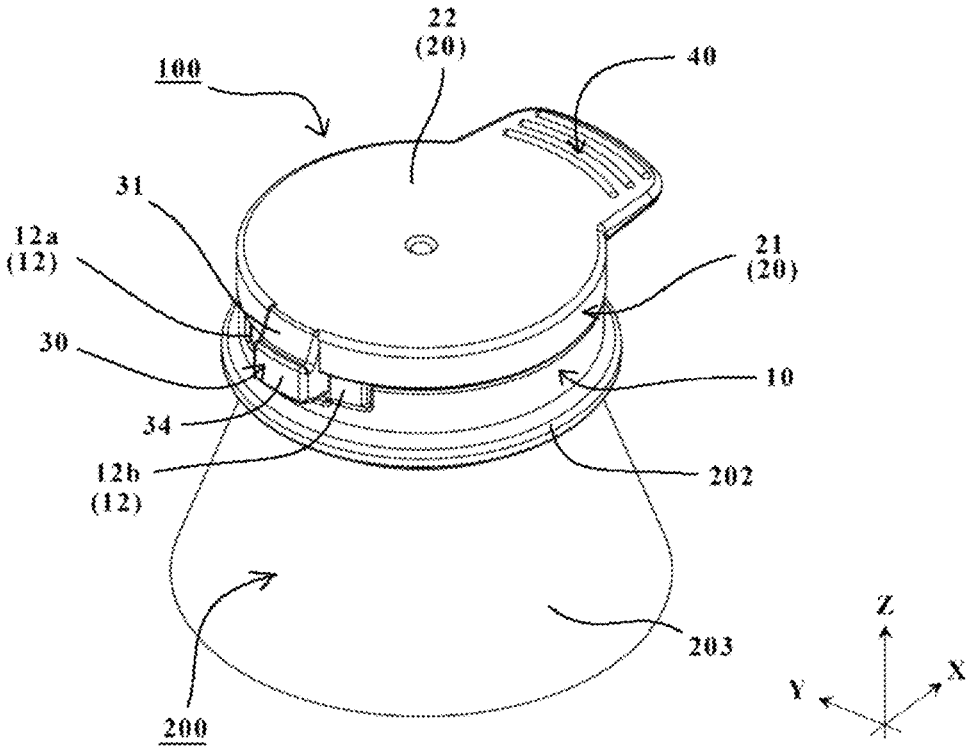
FIG. 2 is an external perspective view of the synthetic resin cap according to the first embodiment as seen from another direction.
Figure 3:
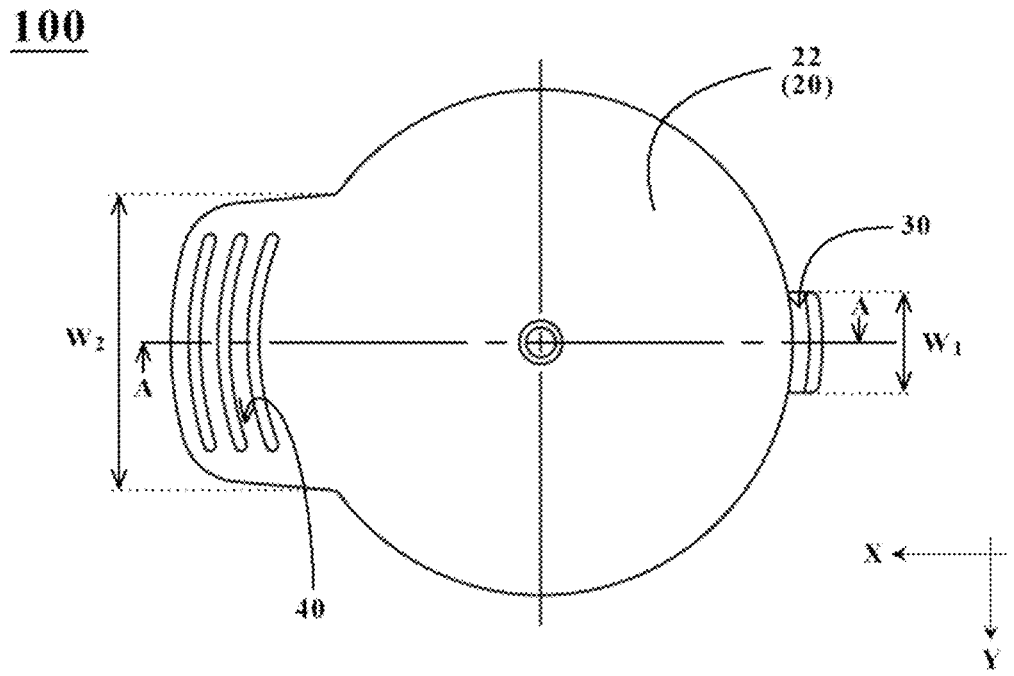
FIG. 3 is a top view of the synthetic resin cap according to the first embodiment as seen from a side of an upper surface.

As depicted in FIG. 1, FIG. 2, etc., the synthetic resin cap 100 of the first embodiment has a function to fit to a spout opening of a container mouth portion 201 in a container 200 to be mentioned below and includes at least a tamper-evident band 10, and a cap main body 20 serving as a generally-called upper lid.

Here, as the container 200 preferred for the first embodiment, a bottle in which, like, for example, a known milk bottle, a cap is pushed and affixed to a container mouth portion can be exemplified. It is however to be noted that, as the container 200, a general bottle in which a refreshing beverage, tea, or the like is stored and a cap is threadedly attached on a container mouth portion may also be used without being limited to the above-described bottle. Further, as the material of the container 200, polyester resins such as, for example, a polyethylene terephthalate (PET) resin are preferred. In addition, various known materials such as, for example, the above-described glass bottle can be used.

Further, the contents to be stored in the container 200 is not particularly limited, and various known liquids such as, for example, milk beverages such as cow's milk and refreshing beverages such as tea can be used. Moreover, as the contents to be stored in the container 200, known solid materials or known semi-solid materials which are in a gel form, such as medicines including tablets and foods, may also be used in place of the above-described various types of liquids.

The container 200 as mentioned above is partly depicted by way of example in FIGS. 1 and 2, etc., and includes the container mouth portion 201 with the spout opening formed therein to pour the contents, a ring-shaped, laterally extending portion 202 disposed below the container mouth portion 201, and a main body 203 located below the laterally extending portion 202 (in the illustration of the figures, only an upper part of the main body 203 is presented, and its lower part is omitted). It is to be noted that the ring-shaped, laterally extending portion 202 depicted in the first embodiment functions as a neck support, which is disposed below the container mouth portion 201, extends to a radially outer side of the container mouth portion 201, and is a part, for example, to be held by a transfer mechanism upon transfer of the container 200 or to be held for prevention of a collapse or the like of the container main body when attaching the cap.

It is to be noted that the laterally extending portion 202 is formed in the ring shape along the entire periphery of the container mouth portion 201 in the first embodiment, but without being limited to this shape, is required only to be formed in a protruding shape extending outwards in a radial direction.

Figure 11:
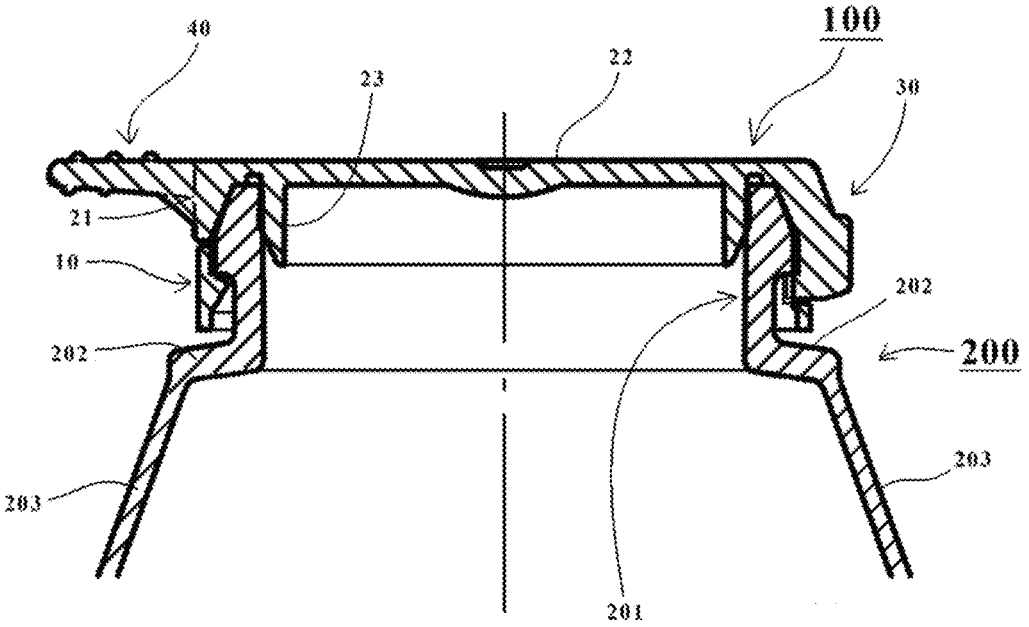
FIG. 11 is a schematic view illustrating another example of a laterally extending portion of a container in the first embodiment.

Further, the laterally extending portion 202 in the first embodiment is not limited to the above-described ring shape, and may be formed in a shape that the laterally extending portion 202 is integrated as a part (which constitutes the upper part) of the main body 203 of the container 200, for example, as illustrated by way of example in FIG. 11.

Taking the neck support, which is depicted in FIG. 1, etc., as an example of the above-described, laterally extending portion 202, the description will hereinafter be continued (will hereinafter be described as the neck support 202). Furthermore, for structures other than those mentioned above with respect to the container 200, known container structures including the above-described PTL 1 and PTL 2 may also be applied.

The synthetic resin cap 100 of the first embodiment may preferably be a push-on cap that an inner ring 23, which will be mentioned subsequently herein, is fitted inside the container mouth portion 201. As the material of the synthetic resin cap 100 as mentioned above, a relatively soft material is preferred. Preferred examples include olefin resins including polypropylene resin and polyethylene resin such as low-density polyethylene called "LDPE," but other known synthetic resins may also be used.

Figure 5:
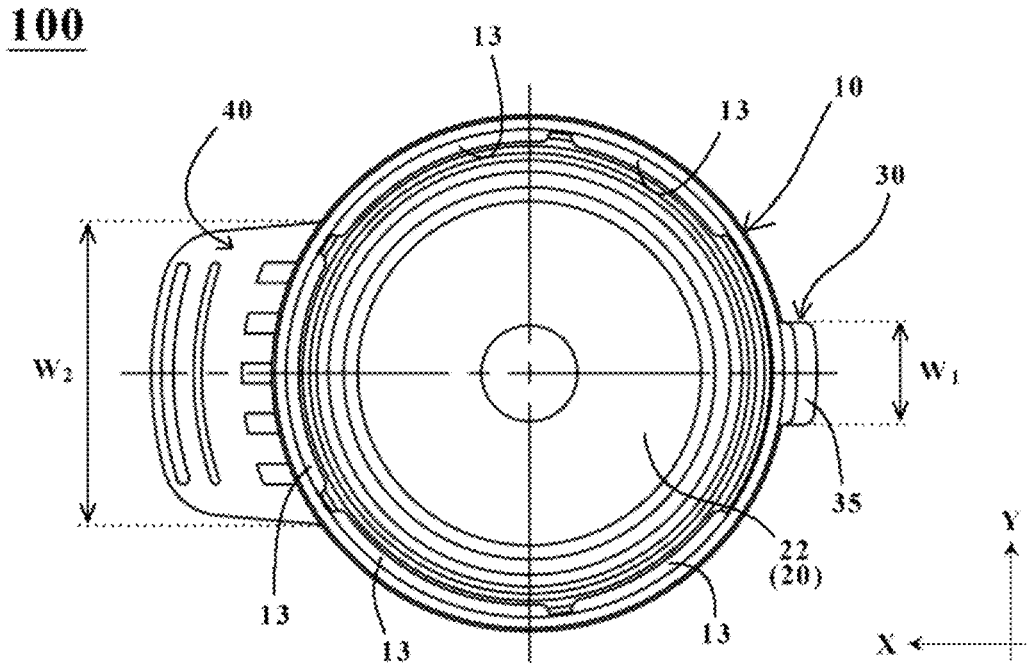
FIG. 5 is a bottom view of the synthetic resin cap according to the first embodiment as seen from a side of a bottom surface.
Figure 6:
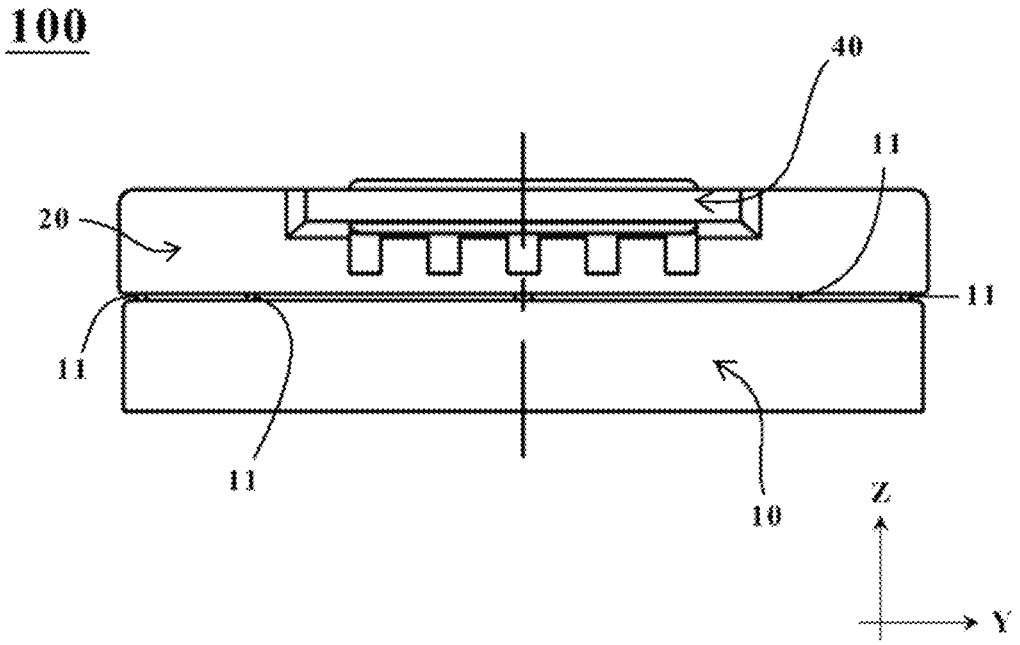
FIG. 6 is a front view of the synthetic resin cap according to the first embodiment as seen from a side of a tab portion.

The tamper-evident band 10, as understood from FIGS. 1, 2, and 5, etc., has a function that it is fitted on an outer peripheral surface of the container mouth portion 201. As depicted in FIG. 5, fitting protrusions 13 are disposed at predetermined intervals on an inner peripheral surface of the tamper-evident band 10. By fitting engagement of the fitting protrusions 13 with the container mouth portion 201, the fitted state on the outer peripheral surface of the container mouth portion 201 is maintained. It is to be noted that, as depicted by way of example in FIG. 5, etc., the tamper-evident band 10 may have a form without the above-described fitting protrusion 13 in a region, where the fixing rib 30 and the strap portion 12 (both, to be mentioned subsequently herein), on a side of the inner peripheral surface thereof.

As depicted in FIGS. 1 and 2, etc., the cap main body 20 has a skirt wall 21 and a top plate 22, and is configured as the upper lid. Of these, the skirt wall 21 is disposed to extend vertically downwards from a peripheral edge of the top plate 22 such that the skirt wall 21 covers the outer peripheral surface of the container mouth portion 210 when the container 200 is closed.

As mentioned above, on an inner side of the top plate 22, the inner ring 23 that can be fitted in the spout opening of the container mouth portion 201 is also formed. It is to be noted that, as the structure of the inner ring 23, various known shapes may be applied as long as the above-described spout opening can be sealed.

The skirt wall 21 is provided around an upper end thereof on a side opposite to a fixing rib 30, which will be described subsequently herein, with a tab portion 40. As understood from FIGS. 4 and 6, the tab portion 40 in the first embodiment is preferably configured having a width W2 greater than a width W1 in a peripheral direction of the fixing rib 30. This allows a user to perform opening operation by efficiently pulling up the cap main body 20, for example, at whichever position in a peripheral direction the tab portion 40 is grasped. It is to be noted that the width W2 of the tab portion 40 is not necessarily required to be greater than the width W1 and may be smaller than or equal to the width W1.

As also depicted in the same figures, the tab portion 40 in the first embodiment preferably extends in the radial direction to such an extent that the drinker can pull up the tab portion 40. This refrains the drinker's fingers from unintentionally coming into contact with the container mouth portion 201 when the container 200 is opened, and therefore is considered to be preferred from the viewpoint of hygiene.

Figure 7A:
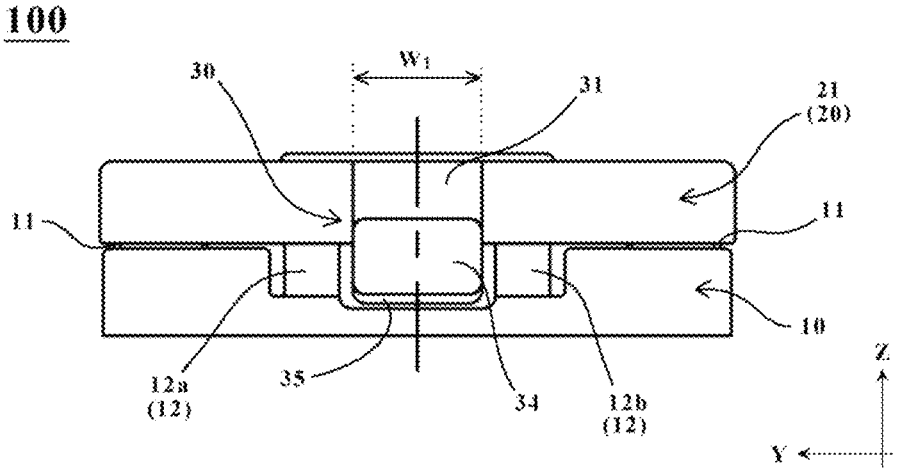
FIGS. 7A and 7B (7A) is a rear view of the synthetic resin cap according to the first embodiment as seen from a side of a fixing rib, and (7B) is a rear view depicting another example of a connection manner of a strap portion to a skirt wall.
Figure 7B:
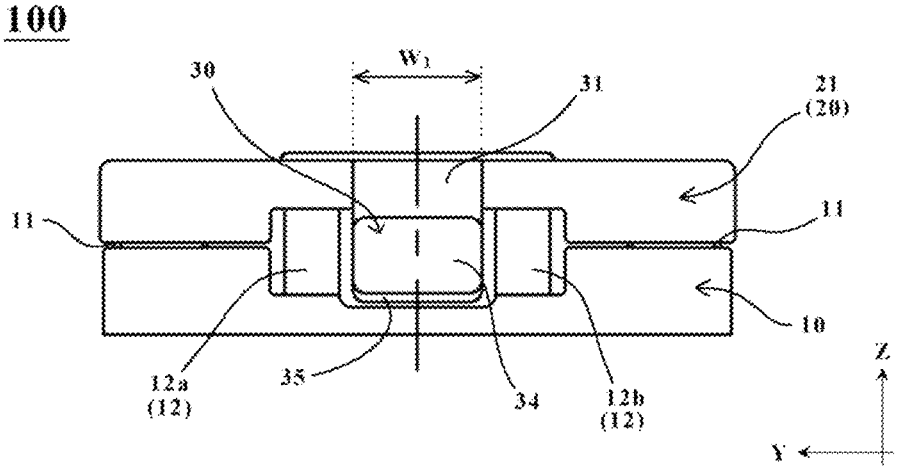

Further, referring to FIGS. 1, 2, 7(*a*) and 8 in combination, the cap main body 20 in the first embodiment is coupled at a lower edge of the above-described skirt wall 21 with the tamper-evident band 10 via weakened portions 11 and a strap portion 12.

It is to be noted that, in FIG. 7(*a*), the strap portion 12 in the first embodiment is connected to the lower edge of the skirt wall 21, but the manner of the connection of the strap portion 12 to the skirt wall 21 is not limited to this structure. Described specifically, as depicted by way of example in FIG. 7(*b*), it may be possible to adopt a structure that portions of the lower edge of the skirt wall 21 may be indented upwards, and the strap portion 12 may be connected at an upper edge thereof to the indented skirt wall 21.

As also appreciated from these figures, the weakened portions 11 are configured with a strength of such a degree that the weakened portions 11 temporarily couple the tamper-evident band 10 and the cap main body 20 together, but can be easily torn, for example, when the user pulls up the tab portion 40 upon opening. In other words, the tamper-evident band 10 and the cap main body 20 are coupled together via the weakened portions 11 in an unopened state, but even once the container 200 is opened, the weakened portions 11 are torn. This serves as evidence of opening.

It is to be noted that the plurality of weakened portions 11 are intermittently disposed about an axis of the cap main body 20 in the first embodiment, but the weakened portions 11 are not limited to this manner. Instead of the above-described structure, it may be possible to adopt a manner that the weakened portions 11 are formed thin and couple the tamper-evident band 10 and the cap main body 20 together continuously along a peripheral direction.

Figure 8:
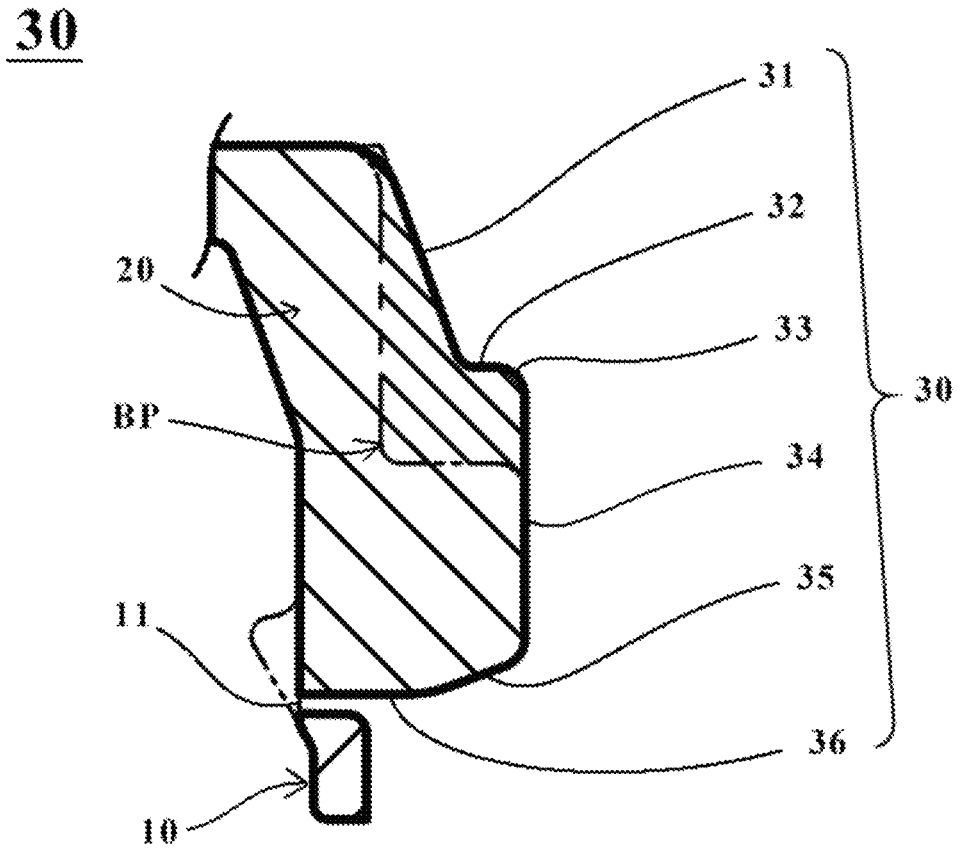
FIG. 8 is a cross-sectional view depicting a structure of the fixing rib in the synthetic resin cap according to the first embodiment.

As depicted in FIGS. 2 and 8, the strap portion 12 is arranged on a side opposite to the tab portion 40, that is, on a side where the fixing rib 30 to be mentioned below is disposed, and is configured with a function that permanently couples the above-described tamper-evident band 10 and the cap main body 20 together.

Described more specifically, the strap portion 12 in the first embodiment, as understood from these figures, includes a pair of a first connector strap 12*a* and a second connector strap 12*b* so as to sandwich the fixing rib 30 therebetween.

When the user pulls up the tab portion 40, for example, upon opening the container 200, the cap main body 20 remains coupled with the tamper-evident band 10 via the strap portion 12. This allows the cap main body 20 to remain unseparated from the container 200 (more precisely, from the tamper-evident band 10 fitted on the container mouth portion 201), thereby preventing falling or loss of the cap main body 20 after the opening.

It is to be noted that, in the first embodiment, the strap portion 12 has at least two connector straps, and the fixing rib 30 is arranged to be interposed between these two connector straps. However, the first embodiment is not limited to the above-described structure. For example, one or three or more connector straps may be disposed, or the strap portion 12 may be in a form that different numbers of connector straps are arranged on opposite sides, respectively, of the fixing rib 30.

Further, as mentioned above, the shape that upon opening, the tab portion 40 is pulled up by the user is exemplified in the first embodiment. In addition to this manner, it also may be possible to adopt, for example, a shape that a finger is hooked on a lower surface of the tab portion 40 and the tab portion 40 is then pushed up from below.

<Fixing Rib 30>

Figure 4:
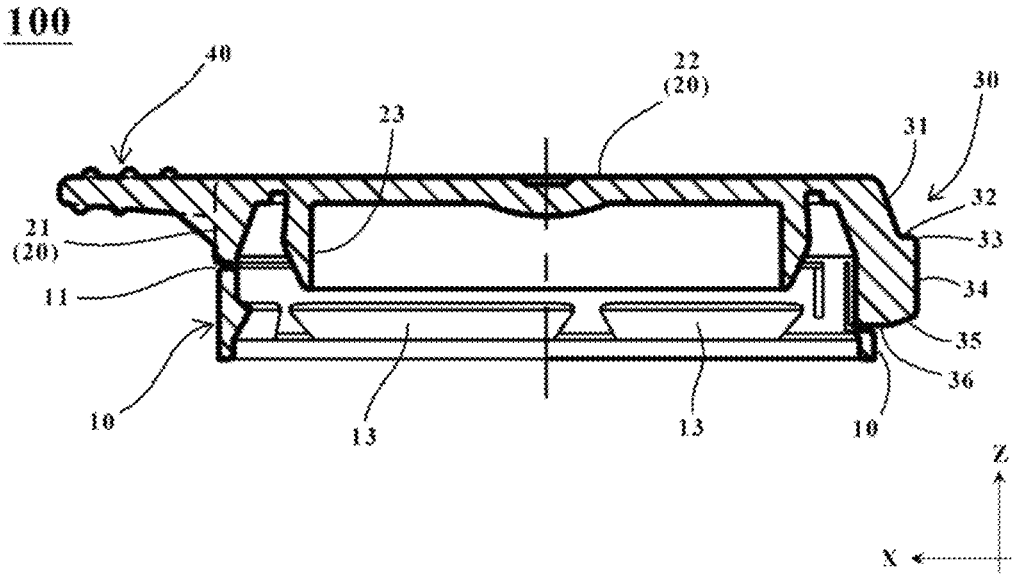
FIG. 4 is an A-A cross-sectional view taken along A-A of FIG. 3.

Referring next in particular to FIGS. 2, 4, and 8, the structure and function of the fixing rib 30 in the first embodiment will be mentioned in detail.

First, as also understood from these figures, the cap main body 20 in the first embodiment further includes the fixing rib 30, which extends vertically downwards from the above-described skirt wall 21 and extends to a radially outer side of the skirt wall 21 (in a −X direction, for example, in FIG. 2).

As depicted in FIG. 2, the fixing rib 30 is disposed on the side opposite to the above-described tab portion 40 in the cap main body 20. As also understood from FIG. 4, the fixing rib 30 is formed in a shape that it substitutes for a portion of the skirt wall 21 in the cap main body 20 in the first embodiment.

Further, as depicted in FIG. 4, the tamper-evident band 10 located below the tab portion 40 is set to have a height (a length in the Z direction) taller than a height of the tamper-evident band 10 located below the fixing rib 30. In other words, the tamper-evident band 10 in the first embodiment is set such that its height is not uniform in the axial direction but differs in the peripheral direction. Furthermore, as mentioned above, on the tamper-evident band 10 in the first embodiment, the fitting protrusions 13 are disposed on the side of the inner peripheral surface along the peripheral direction except for the positions corresponding to the fixing rib 30 and the strap portion 12.

As depicted in FIGS. 2 and 8, etc., the fixing rib 30 in the first embodiment includes, from an upper side on the side of the top plate 22 to a lower side on the side of the tamper-evident band 10, a first inclined portion 31, an intermediate step portion 32, a shoulder portion 33, an outer side surface portion 34, a lower tapered portion 35, and a bottom surface portion 36.

The first inclined portion 31 is formed on a top part of the fixing rib, and has a downwardly flared shape. It is to be noted that the first inclined portion 31 is formed as a linear slope inclined at approximately 20° with respect to a vertical direction as depicted in FIG. 8, but without being limited to this form, may be in the form of a curved surface, or may be an inclined surface of approximately 15° to 25°.

The intermediate step portion 32, as depicted in FIG. 8, etc., is a surface extending to a radially outer side from a lower end of the above-described first inclined portion 31. In more detail, the intermediate step portion 32 in the first embodiment is arranged between the above-described first inclined portion 31 and the shoulder portion 33 to be mentioned subsequently herein and includes a surface substantially parallel to the top plate 22.

The shoulder portion 33, as depicted in FIG. 8, etc., is a part downwardly curved at an outer end portion of the above-described intermediate step portion 32. In more detail, the shoulder portion 33 in the first embodiment is disposed below the above-described first inclined portion 31, and is a corner part in the form of a curved surface continuing at an outer edge of the intermediate step portion 32 to the outer side surface portion 34.

As described above, the fixing rib 30 in the first embodiment has the above-described first inclined portion 31, intermediate step portion 32, and shoulder portion 33. If the fixing rib 30 does not have them, however, the fixing rib 30 has a structure extending downwards from the top plate 22 like the remaining skirt wall 21 (the structure being indicated as a boundary portion BP in FIG. 8). It is to be noted that the heights of arrangements of the intermediate step portion 32 and the shoulder portion 33 (their heights from a lower end of the fixing rib 30) can be set through an experiment or simulation to maintain a flipping angle of the cap main body 20 beyond 180° when the container 200 is opened.

The outer side surface portion 34 is a side surface, which continues from the above-described shoulder portion 33, and juts out to a radially outer side of the skirt wall 21. Formed on a lower side of this outer side surface portion 34 is the lower tapered portion 35 that is tapered (reduced in diameter) downwards.

As understood from FIGS. 2 to 5 and 8, the fixing rib 30 has the intermediate step portion 2, the shoulder portion 33, the outer side surface portion 34, and the lower tapered portion 35, all of which are described above, and therefore includes a part jutting out to a radially outer side below the first inclined portion 31. In the first embodiment, a region that is configured of the intermediate step portion 32, the shoulder portion 33, the outer side surface portion 34, and the lower tapered portion 35 out of the fixing rib 30 is therefore defined as "the protrusion portion."

This lower tapered portion 35 functions as the second inclined portion located below the above-described first inclined portion 31, and is disposed for a purpose of suppressing any interference with the tamper-evident band 10 or a like purpose when the container 200 is opened as will be mentioned below.

Further, the bottom surface portion 36 that makes up a bottom surface of the fixing rib 30 and is in continuation with the above-described lower tapered portion 35 is arranged such that it opposes an upper surface of the above-described tamper-evident band 10 with a predetermined interval therebetween.

According to the synthetic resin cap 100 having the fixing rib 30 configured of the above-described individual parts, it is possible that when the container 200 is opened, (A) the side surface of the container mouth portion 201 and a jut-out portion (the protrusion portion) disposed below the first inclined portion 31 come into contact with each other, and (B) an upper surface 202*a* of the neck support 202 disposed below the container mouth portion 201 and the top plate 22 also come into contact with each other. This maintains the posture of the cap main body 20 when the container 200 is opened.

It is to be noted that, as will be mentioned subsequently herein, a shape in which the shoulder portion 33 out of the protrusion portion comes into contact with the side surface of the container mouth portion 201 (see FIG. 9(*c*), etc.) will be exemplified in the first embodiment, but the fixing rib 30 is not limited to this shape. The fixing rib 30 may be, for example, of a shape in which the outer side surface portion 34, which constitutes the protrusion portion and the side surface of the container mouth portion 201 come into contact with each other. Taking as an example a case in which the shoulder portion 33 out of the protrusion portion and the side surface of the container mouth portion 201 come into contact with each other, in the following description, the description will be continued.

<State Transition when Container is Opened>

Also with reference to FIGS. 9 and 10, a description will next be given regarding an opening method of the synthetic resin cap 100 in the first embodiment while referring to a state transition.

Figure 9A:
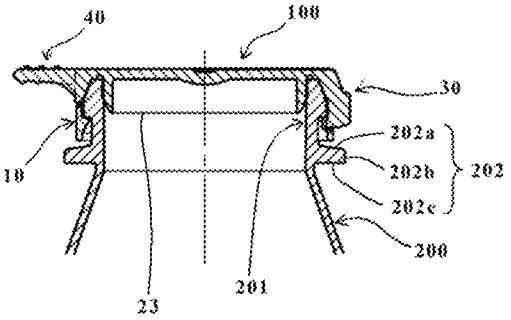
FIGS. 9A-9C depict state transition diagrams illustrating an opening method of the synthetic resin cap according to the first embodiment.
Figure 9B:
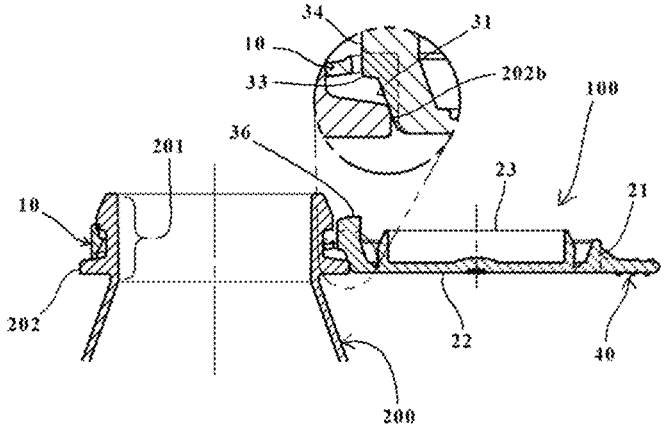
Figure 9C:
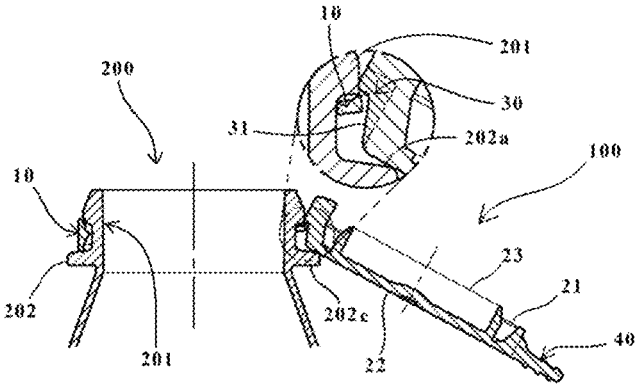

As depicted in FIG. 9, when the drinker drinks the contents (for example, cow's milk or the like) from the container 200, the drinker first opens the synthetic resin cap 100 that seals the spout opening. It is to be noted that, although illustration is omitted, a known cover, such as a shrink film, which covers the synthetic resin cap 100 may further be added to the container 200.

When the container 200 is opened, the drinker first performs an operation to pull up the tab portion 40 with fingers or the like. This pull-up force then tears the weakened portions 11 that temporarily connect the tamper-evident band 10 and the cap main body 20 together. When the weakened portions 11 are torn, the tab portion 40 flips (turns over) upwards about the strap portion 12 as a base point, whereby the inner ring 23 separates from the spout opening of the container 200.

When the cap main body 20 continues the above-described flipping movement at this time as depicted in FIG. 9(*b*), the second inclined portion (lower tapered portion 35) of the fixing rib 30 slidingly rides over the tamper-evident band 10, followed by sliding of the first inclined portion 31 of the fixing rib 30 on a side surface 202*b* of the neck support 202 of the container 200. In this manner, the downwardly flared first inclined portion is formed on the fixing rib 30, the fixing rib 30 can slide smooth against the neck support 202 without being caught as described above.

When the cap main body 20 then further continues the above-described flipping movement as depicted in FIG. 9(*c*), the outer side surface of the container mouth portion 201 and the shoulder portion 33 (protrusion portion) disposed below the above-described first inclined portion 31 come into contact with each other, and the upper surface 202*a* of the neck support 202 disposed below the container mouth portion 201 and the top plate 22 also come into contact with each other, thereby being brought into a state (a state of two-point contact) in which the posture of the cap main body 20 when the container 200 is opened is maintained.

At this time, it is preferred for the cap main body 20 to maintain its posture when the container 200 is opened, in a state in which the cap main body 20 has flipped beyond 180° about the strap portion 12 as a proximal end from the unopened state. It is to be noted that the angle from the above-described unopened state is maintained approximately at 225° or so in the figure, but the above-described angle is an example, and the angle from the above-described unopened state can appropriately be adjusted according to the position and shape of the neck support 202, the preset height of the shoulder portion 33 described above, and the like.

As described above, the shoulder portion 33 (protrusion portion) of the fixing rib 30 in the first embodiment is set in the height of arrangement from the lower end (bottom surface portion 36) of the fixing rib 30 such that the cap main body 20 is flippable beyond 180° in terms of the above-described flipping angle.

Further, as understood from the state transition of FIG. 9(*a*) to FIG. 9(*c*), the fixing rib 30 itself is suppressed from interfering with the tamper-evident band 10 even if the cap main body 20 performs flipping movement at the time of opening the container 200, because the fixing rib 30 in the first embodiment includes the above-described second inclined portion (lower tapered portion 35). This suppresses that the flipping of the cap main body 20 is stopped or otherwise hampered in an initial stage of the opening operation.

As also understood from the state transition of FIG. 9(*b*) to FIG. 9(*c*), the synthetic resin cap 100 of the first embodiment also has such a feature that, when the container 200 is opened, the first inclined portion 31 of the fixing rib 30 slides on the side surface 202*b* of the neck support 202, and the upper edge portion of the top plate 22 is hence guided to be driven toward the upper surface 202*a* of the neck support 202.

Owing to the features as described above, the upper edge portion of the above-described top plate 22 is suppressed from being driven toward a lower surface 202*c* of the neck support 202 in the first embodiment, so that unintended tearing or the like of the tamper-evident band 10 and strap portion 12 is suppressed.

«Synthetic Resin Cap 101 as Comparative Example»

Figure 10A:
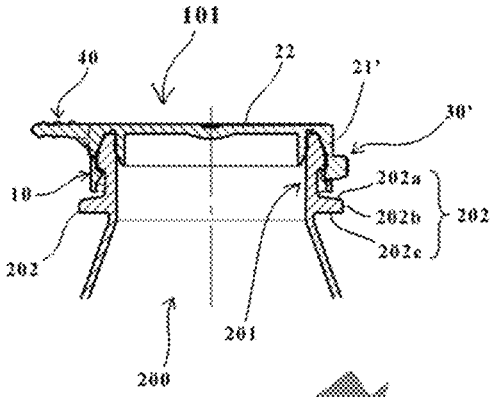
FIGS. 10A-10C depict state transition diagrams illustrating an opening method of a synthetic resin cap in a comparative example.
Figure 10B:
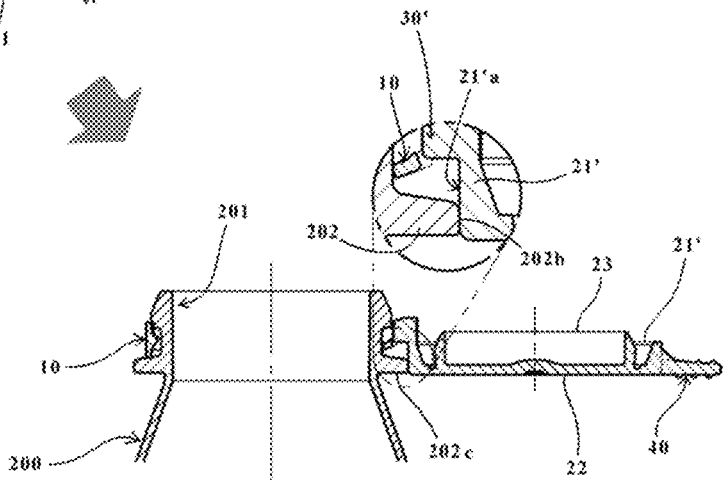
Figure 10C:
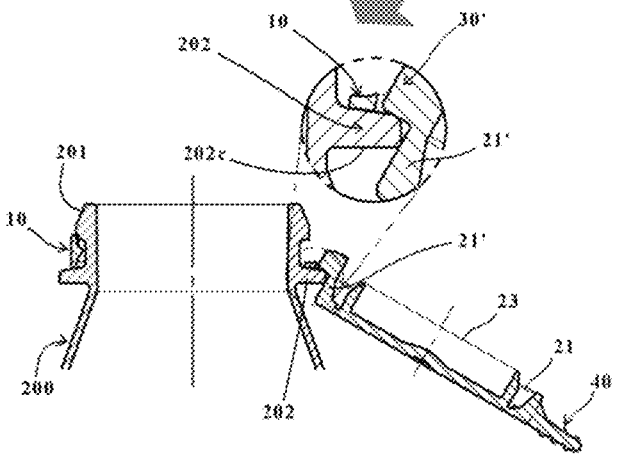

A state transition in an opening method with use of a synthetic resin cap 101 which does not have the above-described fixing rib 30 is depicted in FIG. 10, as a comparative example to the first embodiment. It is to be noted that, in this comparative example, members having the same functions and configurations as in the above-described embodiment are identified by the same reference signs, and their description is omitted.

As appreciated from the figure, the synthetic resin cap 101 of the comparative example does not have the fixing rib 30 in the first embodiment, so that, at the time of opening the container 200, for example, the neck support 202 hardly slides on a skirt wall 21 as in FIG. 10(*b*), leading to a need for a relatively strong force to open.

Moreover, in the synthetic resin cap 101 of the comparative example, the neck support 202 hardly slides on the skirt wall 21, so that, as depicted in FIG. 10(*c*), the upper surface 202*a* of the neck support 202 and the top plate 22 do not come into contact with each other, and the upper edge portion of the top plate 22 is driven toward the lower surface 202*c* of the neck support 202. In this case, an excessive force may be applied, for example, to the tamper-evident band 10 and the strap portion 12, leading to possible tearing of the tamper-evident band 10 and the strap portion 12. Even if the tearing of the strap portion 12 and the like is avoided in this case, the strap portion 12 is excessively stretched to result in a large flip radius of the upper lid (cap main body) at the time of opening the container 200, thereby making it difficult to maintain stable fixing of the upper lid at the time of opening. If the maintenance of the stable fixing of the upper lid is made difficult, the fixing of the upper lid may be unintentionally released when drinking, so that the upper lid flips back in a closing direction. The upper lid may hence possibly interfere, for example, with the nose or the like of the user during drinking.

According to the synthetic resin cap 100 of the first embodiment, on the other hand, the first inclined portion 31 of the fixing rib 30 slides on the side surface 202*b* of the neck support 202 at the time of opening the container 200, so that the upper lid (the upper edge portion of the top plate 22) is guided to be driven toward the upper surface 202*a* of the neck support 202.

After that, the side surface of the container mouth portion 201 and the shoulder portion 33 (protrusion portion) of the fixing rib 30 come into contact with each other, and the upper surface 202*a* of the neck support 202 and the top plate 22 also come into contact with each other (a state of two-point contact).

Owing to the features as described above, the upper edge portion of the above-described top plate 22 is suppressed from being driven toward the lower surface 202*c* of the neck support 202 in the first embodiment, so that unintended tearing or the like of the tamper-evident band 10 and the strap portion 12 can be suppressed while permitting flipping over 180° or greater.

As mentioned above, the synthetic resin cap 100 of the first embodiment may include the above-described second inclined portion (lower tapered portion 35) in the fixing rib 30.

To effectively realize the above-described turnover of the upper lid over 180° or greater, it is desired that, at the time of opening the container 200, the fixing rib 30 rides over the tamper-evident band 10 while somewhat jutting out to the radially outer side. This can be realized by the inclusion of this second inclined portion in the fixing rib 30.

As appreciated from the above, there is evidently a significant difference in not only the openability (the ease of opening) but also in the stability (the absence of unintentional tearing) between the synthetic resin cap 100 of the first embodiment and the synthetic resin cap 101 of the comparative example.

In addition, according to the synthetic resin cap 100 of the first embodiment, a large turnover (a flipping angle, for example, beyond 180°) of the upper lid can be realized with a relatively small amount of resin material owing to the inclusion of the above-described characteristic features, for example, even if the dimensions in the axial direction of the synthetic resin cap 100 are reduced, and therefore, a cost reduction can also be realized while exhibiting the above-described advantageous effects.

Second Embodiment

A description will next be given regarding a second embodiment for suitably practicing the present invention.

It is to be noted that, in this embodiment, the members already described in the first embodiment and those having the same functions as the elements of the first embodiment are identified by the same reference signs, and their description is omitted as appropriate. Accordingly, the description will hereinafter be continued centering around differences from the first embodiment.

«Synthetic Resin Cap 110»

Referring to FIGS. 12 to 18 as needed, a description will be given in detail regarding the structure of a synthetic resin cap 110 according to the second embodiment.

Figure 12:
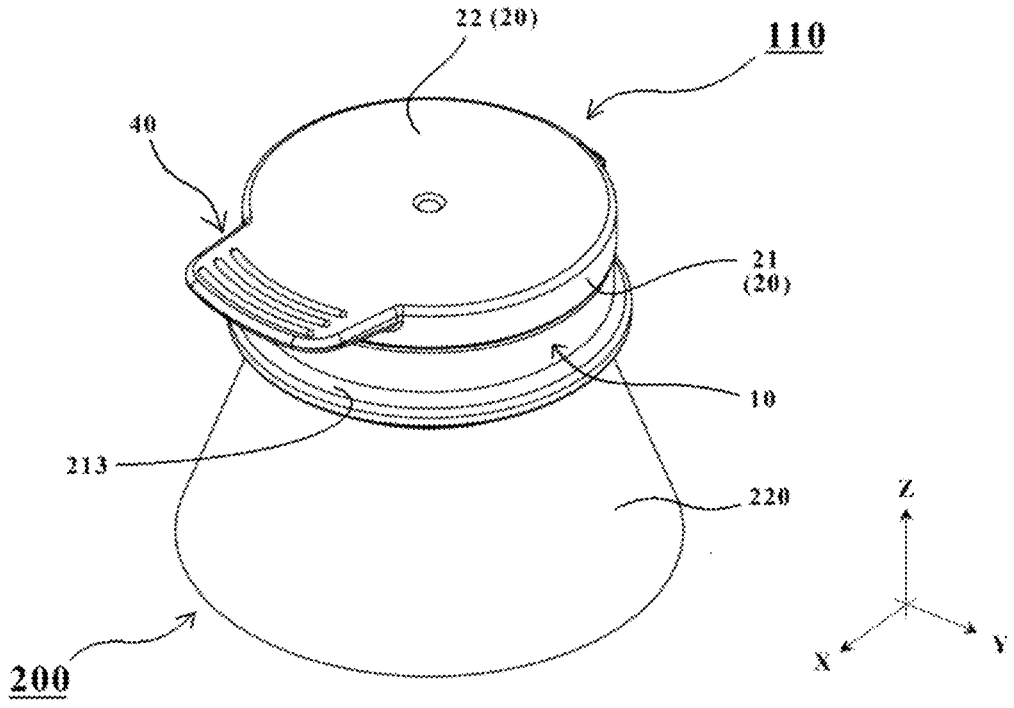
FIG. 12 is an external perspective view of a synthetic resin cap according to a second embodiment as seen from a direction.
Figure 13:
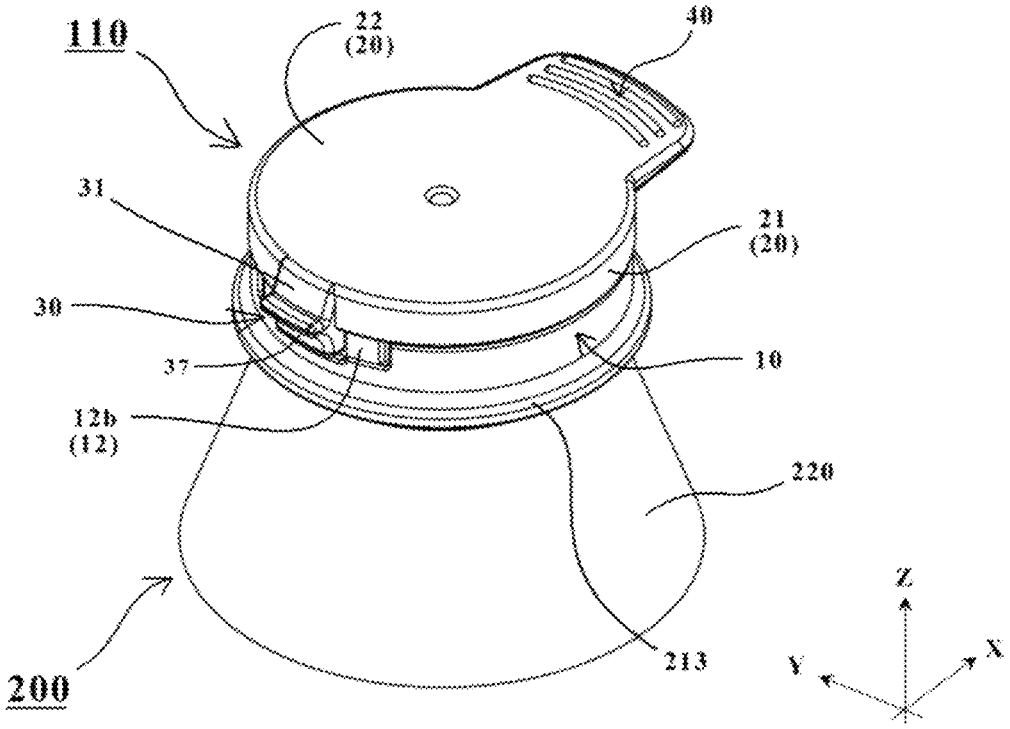
FIG. 13 is an external perspective view of the synthetic resin cap according to the second embodiment as seen from another direction.
Figure 14:
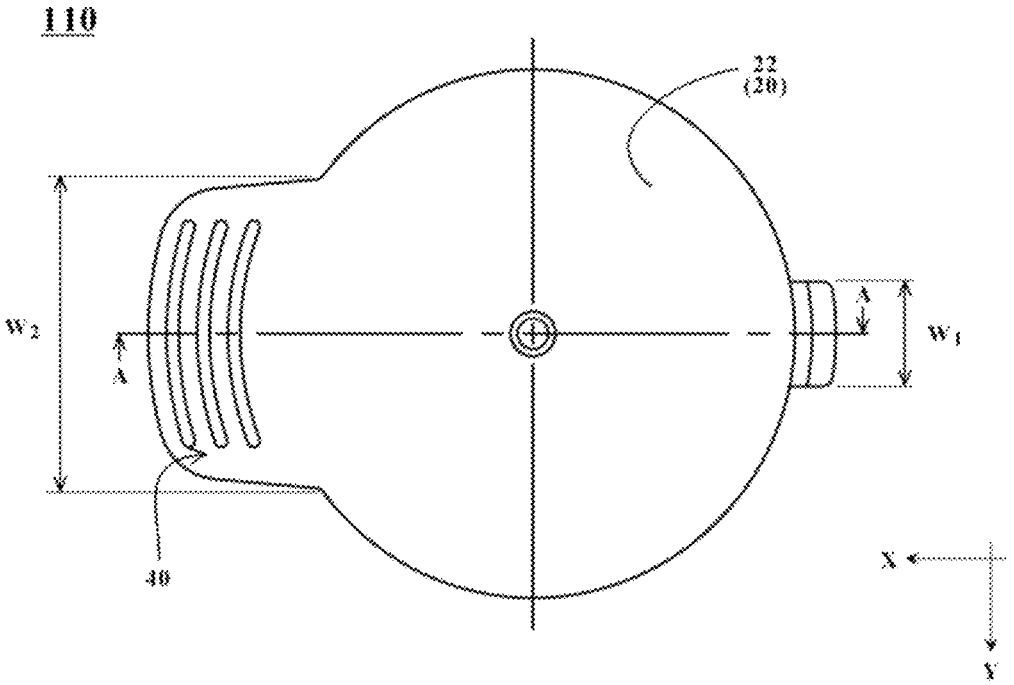
FIG. 14 is a top view of the synthetic resin cap according to the second embodiment as seen from a side of an upper surface.

As depicted in FIG. 12, FIG. 13, etc., the synthetic resin cap 110 of the second embodiment has a function to fit to a container mouth portion 210 in a container 200 to be mentioned below and includes at least the tamper-evident band 10, and the cap main body 20 as the generally-called upper lid.

As depicted by way of example in FIGS. 12, 13, 19, and 20, etc., the container 200 as described above includes the container mouth portion 210, a ring-shaped, laterally extending portion 213 disposed below the container mouth portion 210, and a main body 220 located below the laterally extending portion 213 (in the illustration of the figures, only an upper part of the main body 220 is presented, and its lower part is omitted). Of these, the container mouth portion 210 has a pouring portion 211 through which a spout opening is formed to pour contents, and a reduced diameter portion 212 on which the tamper-evident band 10 to be mentioned subsequently herein is fitted.

Figure 19A:
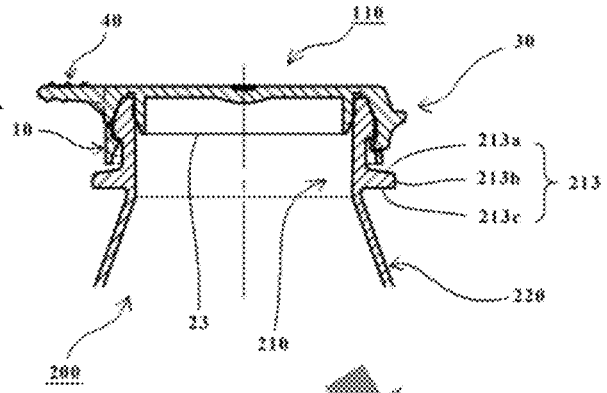
FIGS. 19A-19C depict state transition diagrams illustrating an opening method of the synthetic resin cap according to the second embodiment.
Figure 19B:
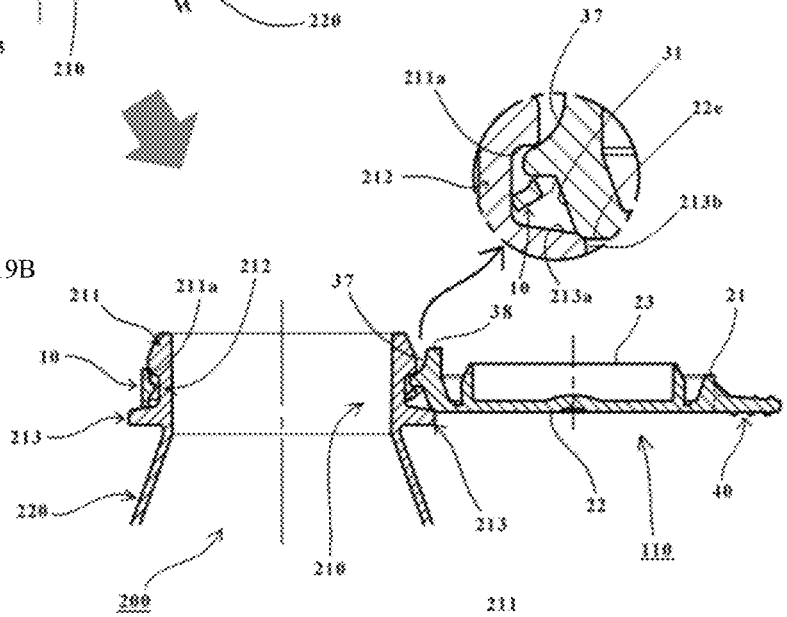
Figure 19C:
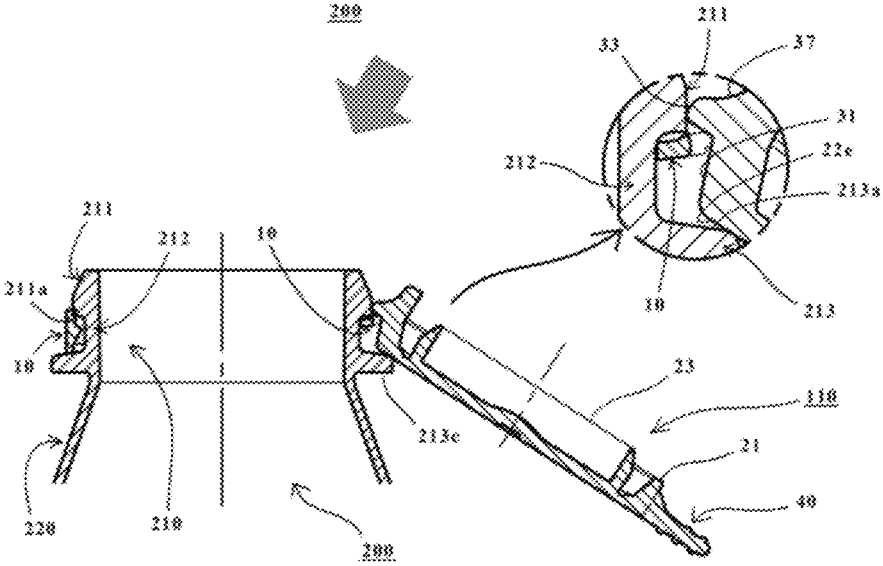

It is to be noted that the reduced diameter portion 212 presented in the second embodiment is a part reduced in diameter below the pouring portion 211, and as depicted in FIG. 19, etc., a jaw portion 211*a* is therefore formed, below the pouring portion 211 in the second embodiment, with its diameter gradually reduced downwards so as to continue from the reduced diameter portion 212.

The ring-shaped, laterally extending portion 213 is disposed below the container mouth portion 210, functions as a neck support extending to a radially outer side of the container mouth portion 210, and is configured to be usable as a part, for example, to be held by a transfer mechanism upon transfer of the container 200 or to be held for prevention of a collapse or the like of the container main body when the cap is attached.

It is to be noted that the laterally extending portion 213 is formed in the ring shape along the entire periphery of the container mouth portion 210 in the second embodiment, but without being limited to this shape, is required only to be formed in a protruding shape extending outwards in a radial direction.

Figure 21:
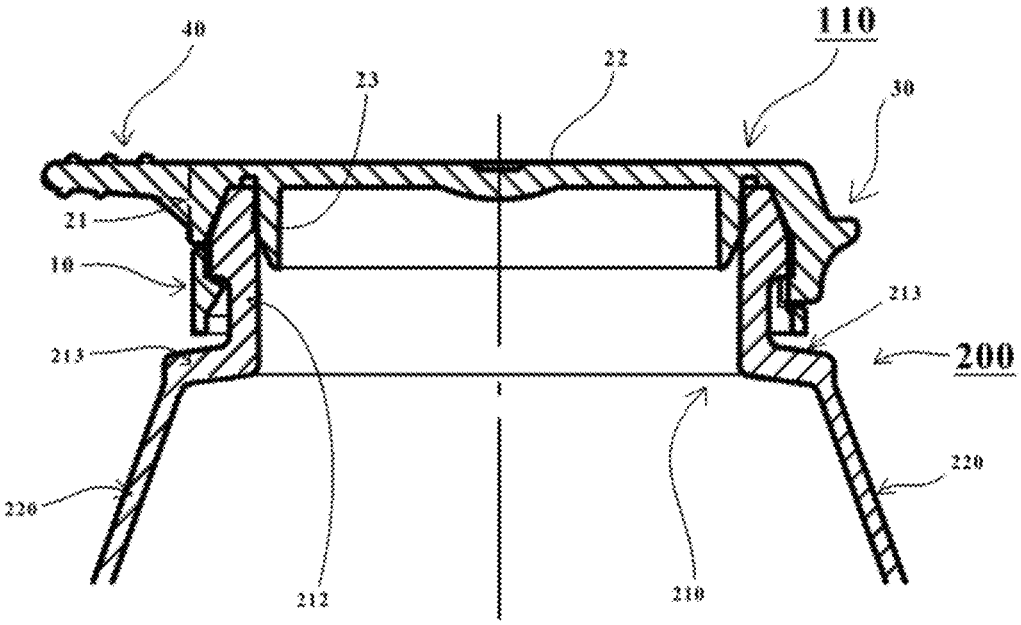
FIG. 21 is a schematic view illustrating another example of a laterally extending portion of a container in the second embodiment.

Further, the laterally extending portion 213 in the second embodiment is not limited to the above-described ring shape, and may be formed in a shape that the laterally extending portion 213 is integrated with a part (which makes up the upper part) of the main body 220 of the container 200, for example, as illustrated by way of example in FIG. 21.

Taking the neck support, which is depicted in FIG. 12, etc., as an example of the above-described laterally extending portion 213, the description will hereinafter be continued (will hereinafter be described as the neck support 213). Furthermore, for structures other than those mentioned above with respect to the container 200, known container structures including the above-described PTL 1 and PTL 2 may also be applied.

The synthetic resin cap 110 of the second embodiment may preferably be a push-on cap that the inner ring 23, which will be mentioned subsequently herein, is fitted inside the container mouth portion 210. As the material of the synthetic resin cap 100 as mentioned above, a relatively soft material is preferred. Preferred examples include olefin resins including polypropylene resin and polyethylene resin such as low-density polyethylene called "LDPE," but other known synthetic resins may also be used.

As depicted in FIGS. 12 and 13, etc., the cap main body 20 has the skirt wall 21 and the top plate 22, and is configured as the upper lid. Of these, the skirt wall 21 is disposed to extend vertically downwards from the peripheral edge of the top plate 22 such that the skirt wall 21 covers at least a part of the outer peripheral surface of the container mouth portion 210 when the container 200 is closed.

<Fixing Rib 30>

Figure 15:
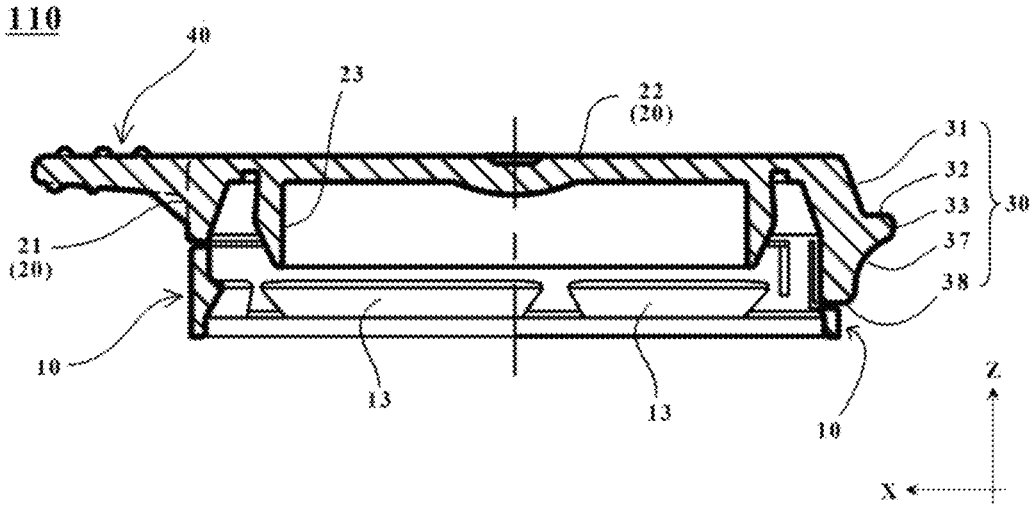
FIG. 15 is an A-A cross-sectional view taken along A-A of FIG. 14.
Figure 16:
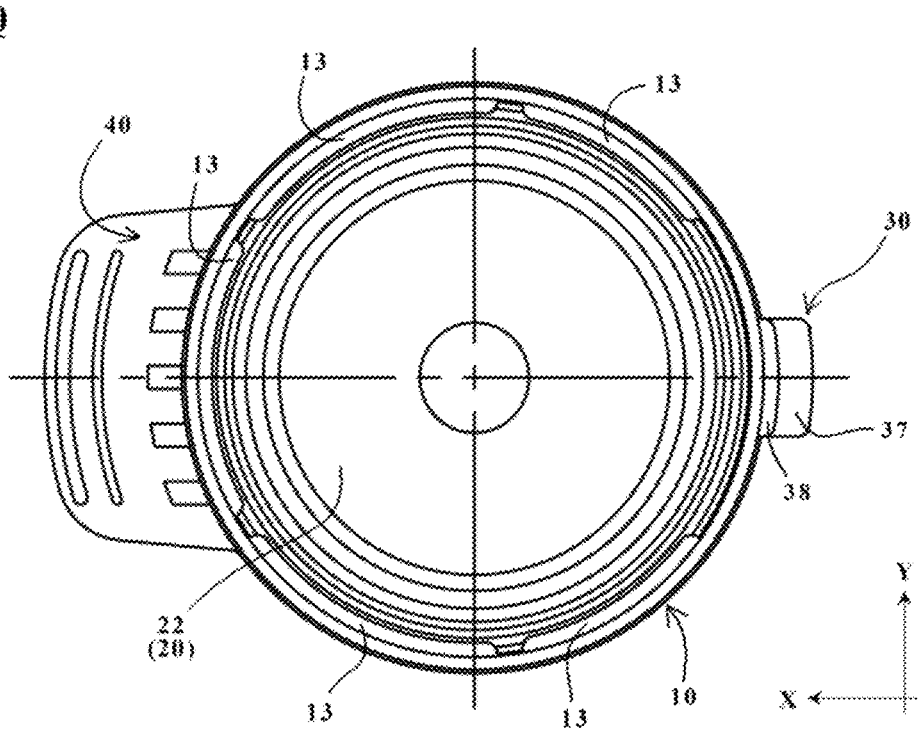
FIG. 16 is a bottom view of the synthetic resin cap according to the second embodiment as seen from a side of a bottom surface.
Figure 17A:
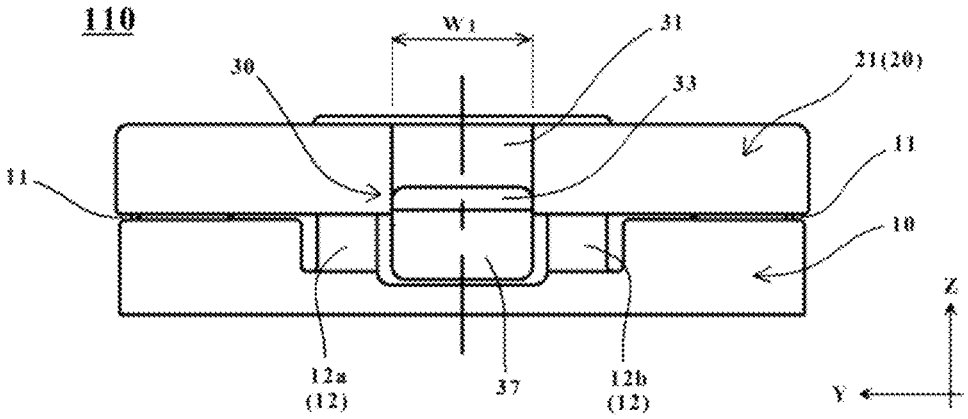
Figure 17B:
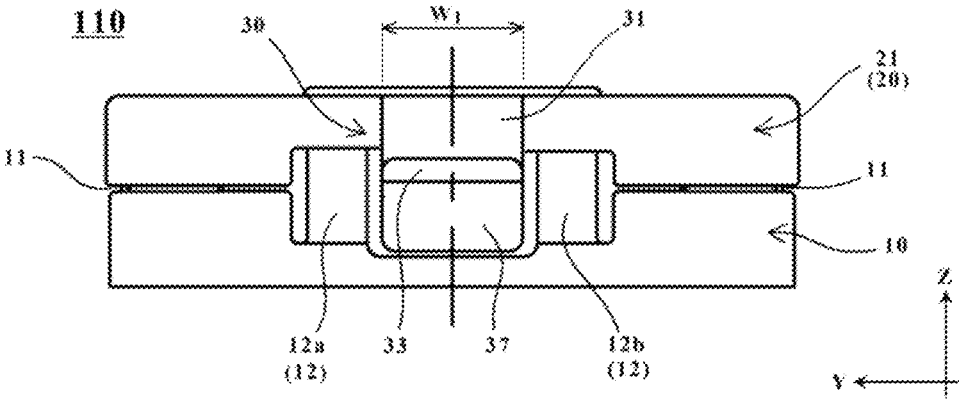
Figure 18:
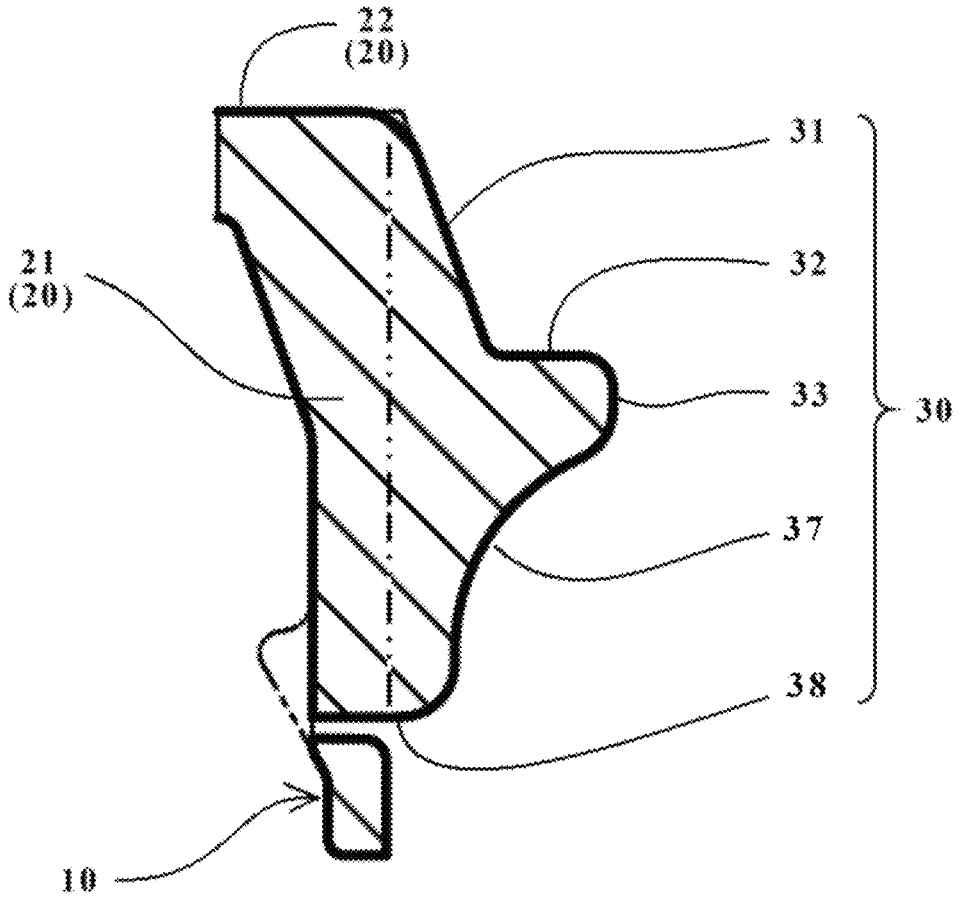
FIG. 18 is a cross-sectional view depicting a structure of the fixing rib in the synthetic resin cap according to the second embodiment.

Referring next in particular to FIGS. 13, 15, and 18, the structure and the function of a fixing rib 30 in the second embodiment will be mentioned in detail.

First, as also understood from these figures, the cap main body 20 in the second embodiment further includes the fixing rib 30, which extends vertically downwards from the above-described skirt wall 21 and extends to a radially outer side of the skirt wall 21 (in a −X direction, for example, in FIG. 13).

As depicted in FIG. 13, the fixing rib 30 is disposed on a side opposite to the above-described tab portion 40 in the cap main body 20. As also understood from FIG. 15, the fixing rib 30 is formed in a shape that it substitutes for a portion of the skirt wall 21 in the cap main body 20 in this embodiment.

Further, as depicted in FIG. 15, the tamper-evident band 10 located below the tab portion 40 is set to have the height (the length in the Z direction) taller than the height of the tamper-evident band 10 located below the fixing rib 30. In other words, the tamper-evident band 10 in this embodiment is set such that its height is not uniform in the axial direction and differs in the peripheral direction. Furthermore, as mentioned above, on the tamper-evident band 10 in this embodiment, the fitting protrusions 13 are disposed on the side of the inner peripheral surface along the peripheral direction except for the positions corresponding to the fixing rib 30 and the strap portion 12.

As depicted in FIGS. 13, 15, and 18, etc., the fixing rib 30 in this embodiment includes, from the upper side on the side of the top plate 22 to the lower side on the side of the tamper-evident band 10, the first inclined portion 31, the intermediate step portion 32, the shoulder portion 33, a curved portion 37, and a lower bottom surface portion 38.

The first inclined portion 31 is formed on the top part of the fixing rib and has the downwardly flared shape. It is to be noted that the first inclined portion 31 is formed as the linear slope inclined at approximately 20° with respect to the vertical direction as depicted in FIG. 18, but without being limited to this shape, may be in the shape of a curved surface, or may be an inclined surface of approximately 15° to 25°.

The intermediate step portion 32, as depicted in FIG. 18, etc., is the surface extending to the radially outer side from the lower end of the above-described first inclined portion 31. In more detail, the intermediate step portion 32 in this embodiment is arranged between the above-described first inclined portion 31 and the shoulder portion 33 to be mentioned subsequently herein and includes the surface substantially parallel to the top plate 22.

The shoulder portion 33, as depicted in FIG. 18, etc., is the part downwardly curved at the outer end portion of the above-described intermediate step portion 32. In more detail, the shoulder portion 33 in this embodiment is disposed below the above-described first inclined portion 31, and is the corner part in the shape of the curved surface continuing at the outer edge of the intermediate step portion 32 to the curved portion 37.

It is to be noted that the heights of arrangements of the intermediate step portion 32 and the shoulder portion 33 (their heights from the lower end of the fixing rib 30) can be set through an experiment or simulation, which takes the material and the like of the synthetic resin cap 100 into account, to maintain a flipping angle of the cap main body 20 beyond 180° at the time of opening the container 200.

As depicted in FIG. 18, etc., the curved portion 37 is a part that is gradually reduced downwards in diameter in continuation from the above-described shoulder portion 33. As understood from the figures, this curved portion 37 is a side surface that juts out to a radially outer side of the skirt wall 21 described above, and at the time of opening the container 200, the jaw portion 211*a* disposed on the container mouth portion 210 (pouring portion 211) can slide along the curved curve.

It is to be noted that, as understood from FIG. 18, etc., the curved portion 37 in this embodiment is preferably configured of a curved surface, the curved surface being upwardly protruding in a state that the cap main body 20 seals the container mouth portion 210, so that an opening force required for turnover of the cap main body 20 via the strap portion 12 at the time of opening the container 200 increases gradually. As mentioned above, the user can therefore be refrained from carelessly stopping the opening operation before its completion.

It is to be noted that the curved portion 37 in this embodiment is configured of the curved surface, the curved surface being upwardly protruding in the state that the container mouth portion 210 is sealed, as described above, but is not limited to this shape as long as the above-described function is exhibited. For example, the curved surface of the curved portion 37 may have a curvature of such a degree that is substantially close to that of a straight line.

Further, for example, in the case of a shape omitting the effect that the riding resistance of the jaw portion 211*a* on the curved portion 37 gradually increases, a tapered second inclined portion (not depicted) as the curved portion 37, the diameter of which is uniformly reduced downwards (in a direction from the shoulder portion 33 toward the lower bottom surface portion 38 in FIG. 18), may be interposed, for example, as the curved portion 37 between the shoulder portion 33 and the lower bottom surface portion 38.

The lower bottom surface portion 38 is disposed below the above-described curved portion 37 as depicted in FIG. 18, etc. This lower bottom surface portion 38 includes a bottom surface that is substantially parallel to the above-described top plate 22. In addition, the lower bottom surface portion 38 in this embodiment is arranged facing the upper surface of the tamper-evident band 10 with a predetermined interval left between itself and the tamper-evident band 10.

As understood from FIGS. 13 to 16 and 18, the fixing rib 30 has the intermediate step portion 32, the shoulder portion 33, and the curved portion 37, all of which are described above, and therefore includes a part jutting out to a radially outer side below the first inclined portion 31. In the second embodiment, a region that is configured of the intermediate step portion 32, the shoulder portion 33, and the curved portion 37 out of the fixing rib 30 is therefore defined as "a protrusion portion."

It is to be noted that the curved portion 37 and the lower bottom surface portion 38 are formed in a continuous shape in the second embodiment, but without being limited to this shape, for example, a third inclined portion (not depicted) the diameter of which is reduced downwards may further be interposed between the curved portion 37 and the lower bottom surface portion 38. Owing to the inclusion of the third inclined portion as described above, it is possible to further suppress the interference with the tamper-evident band 10, for example, at the time of opening the container 200.

According to the synthetic resin cap 110 having the fixing rib 30 configured of the above-described individual parts, it is possible that, at the time of opening the container 200, (A) the side surface of the container mouth portion 210 and the protrusion portion (shoulder portion 33) disposed below the first inclined portion 31 come into contact with each other, and (B) an upper surface 213*a* of the neck support 213 disposed below the container mouth portion 210 and the top plate 22 also come into contact with each other. This maintains the posture of the cap main body 20 at the time of opening the container 200.

It is to be noted that, as will be mentioned subsequently herein, a shape in which the shoulder portion 33 out of the protrusion portion comes into contact with the side surface of the container mouth portion 210 (see FIG. 19(*c*), etc.) will be exemplified in this embodiment, but the fixing rib 30 is not limited to this shape. The fixing rib 30 may be, for example, of a shape in which the curved portion 37, which constitutes the protrusion portion, and the side surface of the container mouth portion 210 come into contact with each other. Taking as an example the case in which the shoulder portion 33 out of the protrusion portion and the side surface of the container mouth portion 210 come into contact with each other in the following description, the description will be continued.

<State Transition when Container is Opened>

Also using FIGS. 19 and 20, a description will next be given regarding an opening method of the synthetic resin cap 110 in this embodiment while referring to a state transition.

As depicted in FIG. 19, when the drinker drinks the contents (for example, cow's milk or the like) from the container 200, the drinker first opens the synthetic resin cap 110 that seals the spout opening. It is to be noted that, although illustration is omitted, a known cover, such as a shrink film, which covers the synthetic resin cap 110 may further be added to the container 200.

When the container 200 is opened, the drinker first performs an operation to pull up the tab portion 40 with fingers or the like. This pull-up force then tears the weakened portions 11 that temporarily connect the tamper-evident band 10 and the cap main body 20 together. When the weakened portions 11 are torn, the tab portion 40 flips (turns over) upwards about the strap portion 12 as a base point, whereby the inner ring 23 separates from the spout opening of the container 200.

When the cap main body 20 continues the above-described flipping movement at this time as depicted in FIG. 19(*b*), the jaw portion 211*a* disposed on the pouring portion 211 in the container mouth portion 210 slides along the curved portion 37. As mentioned above, in this embodiment, the curved surface on the curved portion 37 is configured to lie upwardly protrude in a state in which the container mouth portion 210 is sealed. An opening force that the drinker feels at this time therefore gradually increases with the above-described flipping movement.

While the jaw portion 211*a* is sliding on the curved surface of the curved portion 37, the first inclined portion 31 of the fixing rib 30 slides on a side surface 213*b* of a neck support 213 of the container 200. In this manner, the downwardly flared first inclined portion 31 is formed on the fixing rib 30, the fixing rib 30 can slide smooth against the neck support 213 without being caught as described above.

When the cap main body 20 then further continues the above-described flipping movement as depicted in FIG. 19(*c*), subsequent to sliding of the jaw portion 211*a* which is disposed on the container mouth portion 210 (pouring portion 211), along the curved portion 37, the outer side surface of the container mouth portion 210 and the shoulder portion 33 (protrusion portion) disposed below the above-described first inclined portion 31 come into contact with each other, and the upper surface 213*a* of the neck support 213 disposed below the container mouth portion 210 and the top plate 22 also come into contact with each other, thereby being brought into a state (a state of two-point contact) in which the posture of the cap main body when the container 200 is opened is maintained.

At this time, it is preferred for the cap main body 20 to maintain its posture when the container 200 is opened, in a state in which the cap main body 20 has flipped beyond 180° about the strap portion 12 as the proximal end from the unopened state. It is to be noted that the angle from the above-described unopened state is maintained approximately at 225° or so in the figure, but the above-described angle is an example, and the angle from the above-described unopened state can appropriately be adjusted according to the position and shape of the neck support 213, the preset height of the shoulder portion 33, and the like.

As described above, the shoulder portion 33 (protrusion portion) of the fixing rib 30 in this embodiment is set in the height of arrangement from the lower end (bottom surface portion 36) of the fixing rib 30 such that the cap main body 20 is flippable beyond 180° in terms of the above-described flipping angle.

As also understood from the state transition of FIG. 19(*b*) to FIG. 19(*c*), the synthetic resin cap 110 of this embodiment also has such a feature that, when the container 200 is opened, the first inclined portion 31 of the fixing rib 30 slides on the side surface 213*b* of the neck support 213, and an upper edge portion 22*e* of the top plate 22 is hence guided to be driven toward the upper surface 213*a* of the neck support 213.

Owing to the features as described above, the upper edge portion 22*e* of the above-described top plate 22 is suppressed from being driven toward a lower surface 213*c* of the neck support 213 in this embodiment, so that unintended tearing or the like of the tamper-evident band 10 and the strap portion 12 is suppressed.

In this embodiment, it is also configured that the fixing rib 30 comes into contact with the side surface of the container mouth portion 210 to emit a sound by cooperation with (effects of elastic deformation of) the tamper-evident band 10 after the jaw portion 211*a* disposed on the container mouth portion 210 has ridden over the curved portion 37 in the state transition from FIG. 19(*b*) to FIG. 19(*c*). This also allows the drinker to grasp the completion of the opening operation by auditory perception (effects of contact sound) in addition to the above-mentioned gradual increase of the opening force.

«Synthetic Resin Cap 111 as Comparative Example»

Figure 20A:
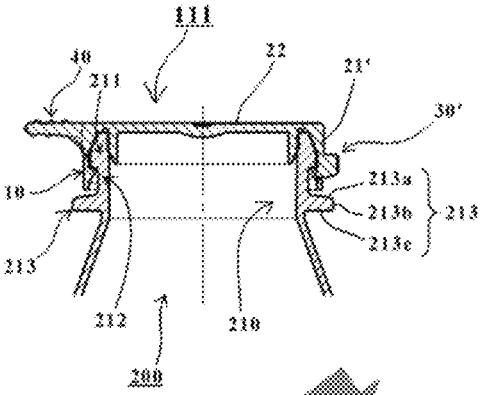
FIGS. 20A-20C depict state transition diagrams illustrating an opening method of a synthetic resin cap in a comparative example.
Figure 20B:
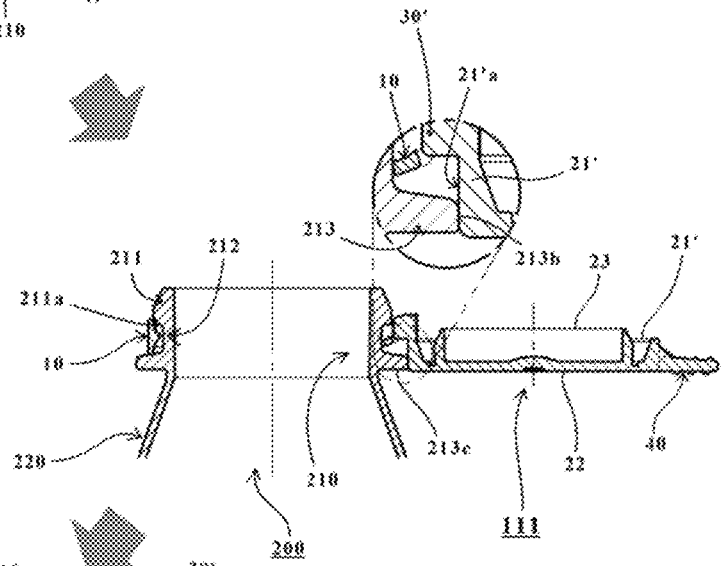
Figure 20C:
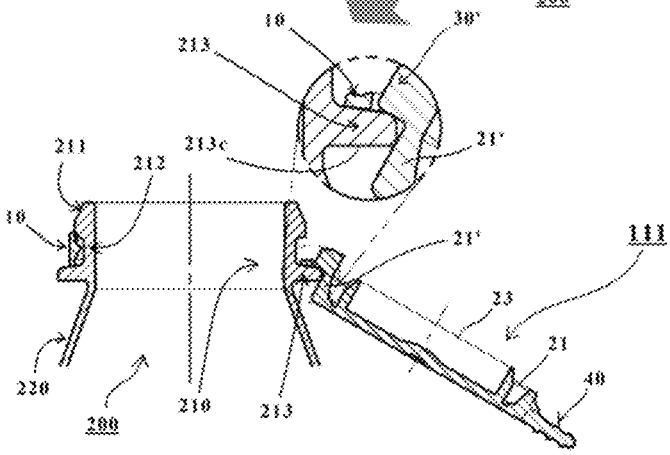

A state transition in an opening method with use of a synthetic resin cap 111 which does not have the above-described fixing rib 30, as a comparative example to this embodiment is depicted in FIG. 20. It is to be noted that, in this comparative example, members having the same functions and configurations as in the above-described embodiment are identified by the same reference signs, and their description is omitted.

As appreciated from the figure, the synthetic resin cap 111 of the comparative example does not have the fixing rib 30 in this embodiment, so that, when the container is opened, for example, the neck support 213 hardly slides on the skirt wall 21 as in FIG. 20(*b*), leading to a need for a relatively strong force to open.

Moreover, in the synthetic resin cap 111 of the comparative example, the neck support 213 hardly slides on the skirt wall 21, so that, as depicted in FIG. 20(*c*), the upper surface 213*a* of the neck support 213 and the top plate 22 do not come into contact with each other, and the upper edge portion of the top plate 22 is driven toward the lower surface 213*c* of the neck support 213. In this case, an excessive force may be applied, for example, to the tamper-evident band 10 and the strap portion 12, leading to possible tearing of the tamper-evident band 10 and the strap portion 12.

Even if the tearing of the strap portion 12 and the like is avoided in this case, the strap portion 12 is excessively stretched to result in a large flip radius of the upper lid (cap main body) at the time of opening the container 200, thereby making it difficult to maintain stable fixing of the upper lid after the opening of the container 200. If the maintenance of the stable fixing of the upper lid becomes difficult, the fixing of the upper lid is unintentionally released when drinking, so that the upper lid flips back in the closing direction. The upper lid may hence possibly interfere, for example, with the nose or the like of the user (drinker) during drinking.

According to the synthetic resin cap 110 of the second embodiment, on the other hand, the first inclined portion 31 of the fixing rib 30 slides on the side surface 213*b* of the neck support 213 when the container 200 is opened, so that the upper lid (the upper edge portion of the top plate 22) is guided to be driven toward the upper surface 213*a* of the neck support 213.

After that, the side surface of the container mouth portion 210 and the shoulder portion 33 (protrusion portion) of the fixing rib 30 come into contact with each other, and the upper surface 213*a* of the neck support 213 and the top plate 22 also come into contact with each other (a state of two-point contact).

Owing to the features as described above, the upper edge portion of the above-described top plate 22 is also suppressed from being driven toward the lower surface 213*c* of the neck support 213 in the second embodiment, so that unintended tearing or the like of the tamper-evident band 10 and the strap portion 12 can be suppressed while permitting flipping over 180° or greater.

It is to be noted that, with respect to the synthetic resin cap 110 of the second embodiment, the modification in which the second inclined portion is interposed between the shoulder portion 33 and the lower bottom surface portion 38 is also presented above as a further shape of the curved portion 37 in the fixing rib 30, and while the fixing rib 30 still includes the curved portion 37 (the curved portion 37 of a first pattern) of the shape that the resistance increases gradually when the fixing rib 30 rides over the tamper-evident band 10, the above-described second inclined portion may further be interposed as a curved portion 37 of a second pattern between the curved portion 37 of the first pattern and the lower bottom surface portion 38. To more effectively realize the above-described turnover of the upper lid, for example, over 180° or greater, it is desired that, when the container 200 is opened, the fixing rib 30 rides over the tamper-evident band 10 while somewhat jutting out to the radially outer side. This movement can be realized more easily by the inclusion of both the curved portions 37 of these first pattern and second pattern in the fixing rib 30.

As appreciated from the above, there is evidently a significant difference in not only the openability (the ease of opening) but also in the stability (the absence of unintentional tearing) between the synthetic resin cap 110 of the second embodiment and the synthetic resin cap 111 of the comparative example.

In addition, according to the synthetic resin cap 110 of the second embodiment, a large turnover (a flipping angle, for example, beyond 180°) of the upper lid can be realized with a relatively small amount of a resin material owing to the inclusion of the above-described features, for example, even if the dimensions in the axial direction of the synthetic resin cap 110 are reduced, and therefore, a cost reduction can also be realized while exhibiting the above-described advantageous effects.

It is to be noted that the above-described individual embodiments are illustrative, and various modifications can be made without departing from the spirit of the present application. For example, the inner ring 23 is disposed on the inner side (bottom surface) of the top plate 22 of the synthetic resin cap 110, but instead of or in addition to the inner ring 23, a known packing or the like may be disposed on the side of the bottom surface of the top plate 22.

The position in the axial direction (height direction, Z direction) of the tab portion 40 in each embodiment may be appropriately changed according to the design value of the opening force by drinkers. Described specifically, the above-described tab portion 40, with respect to the above-described axial direction, may be disposed at a position higher than the intermediate step portion 32 of the fixing rib 30, or may be disposed at a position lower than the intermediate step portion 32.

INDUSTRIAL APPLICABILITY

The present invention is suited for realizing a cap that is further improved in convenience when drinking while suppressing falling or loss of the cap when opened.

REFERENCE SIGNS LIST

100, 101, 110, 111: Synthetic resin cap
10: Tamper-evident band
20: Cap main body
21: Skirt wall
22: Top plate
23: Inner ring
30: Fixing rib
31: First inclined portion
32: Intermediate step portion
33: Shoulder portion
34: Outer side surface portion
35: Lower tapered portion
36: Bottom surface portion
37: Curved portion
38: Lower bottom surface portion
40: Tab portion
200: Container
201: Container mouth portion
202: Neck support (an example of laterally extending portion)
210: Container mouth portion
211: Pouring portion
212: Reduced diameter portion
213: Neck support (an example of laterally extending portion)
220: Main body

The invention claimed is:

1. A synthetic resin cap comprising:

a tamper-evident band to be fitted on an outer peripheral surface of a container mouth portion of a container; and a cap main body having a skirt wall and a top plate, and including, in the skirt wall, a fixing rib coupled with the tamper-evident band via a weakened portion and a strap portion and extending to a radially outer side of the skirt wall, wherein the fixing rib is formed from a first inclined portion that flares downwards, and a protrusion portion that is disposed below the first inclined portion, and when the container is opened, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened.

2. The synthetic resin cap according to claim 1, wherein, with the cap main body flipped beyond 180° about the strap portion as a base point from an unopened state, the posture of the cap main body when the container is opened is maintained.

3. The synthetic resin cap according to claim 2, wherein the protrusion portion is set in height of arrangement from a lower end of the fixing rib such that the cap main body is flippable beyond 180°.

4. The synthetic resin cap according to claim 1, wherein, when the container is opened, the first inclined portion slides on a side surface of the laterally extending portion, thereby guiding an upper edge portion of the top plate to be driven onto an upper surface of the laterally extending portion.

5. The synthetic resin cap according to claim 1, wherein the protrusion portion includes an intermediate step portion that extends to a radially outer side of a lower end of the first inclined portion, a shoulder portion that is curved downwards at an outer end portion of the intermediate step portion, and an outer side surface portion that juts out to the radially outer side continuously from the shoulder portion, and the outer side surface portion is provided at a lower end thereof with a second inclined portion tapered downwards so as to suppress any interference with the tamper-evident band when the container is opened.

6. The synthetic resin cap according to claim 1, wherein the strap portion has at least two connector straps, and the fixing rib is disposed so as to be interposed between the two connector straps.

7. The synthetic resin cap according to claim 1, wherein the cap main body further includes a tab portion disposed on a side opposite to the fixing rib.

8. The synthetic resin cap according to claim 1, wherein the protrusion portion includes at least an intermediate step portion that extends to the radially outer side, a shoulder portion that is curved downwards at an outer end portion of the intermediate step portion, and a curved portion that is gradually reduced in diameter continuously downwards from the shoulder portion, and the fixing rib comes into contact with the side surface of the container mouth portion to emit a sound after a jaw portion disposed on the container mouth portion has ridden over the curved portion.

9. A synthetic resin cap comprising:

a tamper-evident band to be fitted on an outer peripheral surface of a container mouth portion of a container; and a cap main body having a skirt wall and a top plate, and including, in the skirt wall, a fixing rib coupled with the tamper-evident band via a weakened portion and a strap portion and extending to a radially outer side of the skirt wall, wherein the fixing rib has a protrusion portion including at least an intermediate step portion that extends to the radially outer side, a shoulder portion that is curved downwards at an outer end portion of the intermediate step portion, and a curved portion that is gradually reduced in diameter continuously downwards from the shoulder portion, when the container is opened, after a jaw portion disposed on the container mouth portion has slid along the curved portion, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened, and the protrusion portion further has a first inclined portion that is disposed above the intermediate step portion and flares downwards from the top plate.

10. The synthetic resin cap according to claim 9, wherein the curved portion is formed of a curved surface, the curved surface protruding upwardly in a state that the cap main body seals the container mouth portion such that an opening force required for turnover of the cap main body via the strap portion when the container is opened increases gradually.

11. A synthetic resin cap comprising:

a tamper-evident band to be fitted on an outer peripheral surface of a container mouth portion of a container; and a cap main body having a skirt wall and a top plate, and including, in the skirt wall, a fixing rib coupled with the tamper-evident band via a weakened portion and a strap portion and extending to a radially outer side of the skirt wall, wherein the fixing rib has a protrusion portion including at least an intermediate step portion that extends to the radially outer side, a shoulder portion that is curved downwards at an outer end portion of the intermediate step portion, and a curved portion that is gradually reduced in diameter continuously downwards from the shoulder portion, and when the container is opened, after a jaw portion disposed on the container mouth portion has slid along the curved portion, a side surface of the container mouth portion and the protrusion portion come into contact with each other, and an upper surface of a laterally extending portion, the laterally extending portion being disposed below the container mouth portion and extending in a radial direction, and the top plate come into contact with each other, thereby maintaining a posture of the cap main body when the container is opened.

* * * * *